US007661380B2

(12) United States Patent
Waldecker

(10) Patent No.: US 7,661,380 B2
(45) Date of Patent: Feb. 16, 2010

(54) METHOD OF AND APPARATUS FOR DETECTING AND CONTROLLING BILGE WATER IN A SEA VESSEL

(76) Inventor: Donald E. Waldecker, 521 Central Dr., Suite 201, Virginia Beach, VA (US) 23545

( * ) Notice: Subject to any disclaimer, the term of this patent is extended or adjusted under 35 U.S.C. 154(b) by 619 days.

(21) Appl. No.: 11/342,786

(22) Filed: Jan. 30, 2006

(65) Prior Publication Data

US 2009/0050042 A1 Feb. 26, 2009

(51) Int. Cl.
*B63B 13/00* (2006.01)
*B63B 29/16* (2006.01)
*B63J 4/00* (2006.01)

(52) U.S. Cl. ..... 114/183 R

(58) Field of Classification Search ..... 114/121, 114/125, 183 R

See application file for complete search history.

(56) References Cited

U.S. PATENT DOCUMENTS 3,757,317 A 9/1973 Kahn
4,341,178 A * 7/1982 Price ..... 114/183 R
4,551,069 A 11/1985 Gilmore
4,697,535 A * 10/1987 Wileman, III ..... 114/183 R
4,804,936 A 2/1989 Sale
5,076,763 A 12/1991 Anastos
5,078,577 A * 1/1992 Heckman ..... 417/2
5,324,170 A 6/1994 Anastos
5,357,247 A 10/1994 Marnel
5,506,564 A 4/1996 Hargest
6,005,483 A 12/1999 West
6,218,948 B1 4/2001 Dana
6,473,004 B1 * 10/2002 Smull ..... 340/984
6,774,785 B2 * 8/2004 Schweitzer, III ..... 340/516

* cited by examiner

*Primary Examiner*—Lars A Olson
*Assistant Examiner*—Daniel V Venne
(74) *Attorney, Agent, or Firm*—William G. Sykes

(57) ABSTRACT

An improved bilge water level monitor, alert and control system for boats and other vessels. The system provides a method of detecting excessive leakage of water into the bilge and in response to the excessive water in the bilge, triggering an alarm to notify the operator and others and energizes bilge pumps to remove the excessive water. The system is designed with many redundancies in the sub elements and subsystems for safety. The system provides a means for reducing the likelihood of exhausting battery power in the event of a significant seawater leakage problem. The electrical power rating of the monitoring circuitry components is relatively low, thereby reducing the size and weight of those components relative to prior bilge pump monitoring and alert systems. There is no electrical wiring exposed to bilge water during system operation thereby reducing damage to the wiring components. The water level detection and control circuitry operates with sufficiently low amperage to substantially eliminate the hazard of spark-induced combustion.

11 Claims, 18 Drawing Sheets

METHOD OF AND APPARATUS FOR DETECTING AND CONTROLLING BILGE WATER IN A SEA VESSEL

REFERENCES CITED

U.S. PATENT DOCUMENTS

| | | | |
|---|---|---|---|
| 3,757,317 | September 1973 | Kahn | 340/244 |
| 4,341,178 | July 1982 | Price | 114/183 R |
| 4,551,068 | November 1985 | Boudreaux | 417/8 |
| 4,804,939 | February 1989 | Sale | 338/80 |
| 5,076,763 | December 1991 | Anastos | 417/44 |
| 5,324,170 | June 1994 | Anastos | 417/12 |
| 5,357,247 | October 1994 | Marnel | 340/984 |
| 5,506,564 | April 1996 | Hargest | 340/450.2 |
| 6,005,483 | December 1999 | West | 340/618 |
| 6,218,948 | April 2001 | Dana | 340/604 |
| 6,473,004 | October 2002 | Smull | 340/984 |

CROSS-REFERENCES

The present application is filed with reference to the previously filed provisional patent application, filed on Feb. 4, 2005, entitled "Method of and Apparatus for Detecting and Controlling Bilge Water in a Sea Vessel", Inventor Donald E. Waldecker, Patent Agent Stephen E. Clark.

BACKGROUND OF THE INVENTION

1. Technical Field

The present invention relates to boats and other watercraft and more particularly to systems operative to manage and control as well as monitor the operation of bilge pump systems therefore.

2. Discussion of Related Art

As is well known, most boats, regardless of the material or construction and fabrication thereof, have a tendency to take on a certain amount of water when floating in a body of water. The causes for the accumulation of water vary substantially with different types, materials, and fabrications of boats. However, generally speaking, such causes of water intrusion into the hulls of boats include, among other causes, plumbing failures, seepage through the hull material or joints formed between elements of the hull, leakage or small flaws in the hull integrity, plumbing failures in potable water tanks or in unlimited dock-supplied potable water lines, failures of engine cooling systems and failure of seals utilized with various "through-the-hull" fittings or couplings as well as rain which runs into the bilge.

The operator will generally become aware of water in the bilge by periodic inspection, by observing bilge pump activity, or, in extreme cases, by noticing sluggishness in boat performance caused by the weight of seawater inside the bilge.

Seawater inside the bilge of a vessel is generally removed by a bilge pump, which is typically a battery powered pumping unit that pumps bilge water overboard either in response to a manual switch or automatically in response to the level of seawater in the bilge. In the latter case, a seawater revel detector inside the bilge detects when the seawater is at a predetermined level and electrically energizes the bilge pump until most of the bilge water is pumped overboard.

If there is excessive leakage of seawater into the bilge, the bilge pump will be maintained in operation for a period of time greater than the norm, and in extreme cases, the bilge pump will be maintained continuously on until the battery is exhausted. In the event that inflow of seawater into the bilge is greater than the capacity of the bilge pump, or in the event that electric power is exhausted or otherwise cut off, or in the event of bilge pump failure before the inflow of water is controlled, the level of seawater will rise in the bilge with catastrophic results.

Faced with the need for protecting boats from damage or loss caused by bilge pump failures or inability to respond to excess water collecting within the boat bull, practitioners in the art have provided various alarm and monitoring equipment for use in combination with bilge pump systems. While such systems vary, the overall objective thereof is to provide a type of warning or alarm for indicating a failure of the bilge pump system and/or the accumulation of a potentially damaging amount of water within the bilge of the boat.

For example, U.S. Pat. No. 5,357,247 issued to Marnel et al. sets forth a METHOD AND EQUIPMENT FOR ALERTING OF DANGEROUS WATER LEVELS which function to alert a boat owner, whether on board or at a remote location, to the fact that the water level within the craft has risen above a predetermined level and at a rate which is causing the water level to increase. The system utilizes a continuity board and a power source which when activated completes a circuit to energize onboard alerting devices such as strobe lights as well as a preprogrammed cellular telephone auto dialer and answering machine. The cellular telephone auto dialer and answering machine dials a given sequence of telephone numbers in response to the detection of an alarm condition. Thus, as water level increases, the audible alarm, and strobe lights are energized to provide an indication of a problem. In additional the cellular telephone auto dialer further operates to contact the boat owner at a predetermined remote telephone.

British patent 2,139,793 issued to Ross et al. sets forth an AUTOMATIC BILGE PUMP MONITOR which includes means for energizing and de-energizing a bilge pump in response to sensed water level. The automatic bilge pump monitor further includes an alarm means arranged to provide a warning in the event the bilge pump has been continuously operating in excess of a predetermined time interval. The bilge pump monitor includes a triggerable monostable timer circuit to provide the time interval monitor function for the system.

A problem with prior bilge monitoring and pumping systems is that continuous running of the pump not only means that there is likely a significant leakage problem, but the continuous running of the pump can cause the battery to run down or pump failure to occur, thus rendering the battery/pump system inoperable. Another problem of such prior systems is that switching to manual operation of the pump typically involves bypassing and/or de-energizing the automatic switch and the alarm/monitoring system. Although manual turning "on" of the pump addresses the symptom (i.e., too much water in the bilge), it does not address the problem (e.g., leaking hull).

Another problem of such prior systems is that the electrical power rating of the monitoring circuitry components is typically proportional to the size (footprint and/or volume) and weight of those components. That is, typically, the higher the power rating of the electrical components, the bigger and heavier those components are, and the heavier gauge of the associated wiring and connectors.

Another problem of such prior systems is that manual pump switches are typically located at the bridge of the vessel, whereas the battery is (or batteries are) typically located below deck, and the pump necessarily is located at the bilge.

Typically in such prior systems, one or more power lines run from the battery (located below deck), to a switch on the bridge, to the pump (located in or near the bilge). Because such pumps often have high power ratings, it is necessary in such prior systems to run heavy gauge (i.e., relatively expensive, bulky and heavy) power lines long distance throughout the vessel.

Another problem is that the electrical wiring associated with water level-detecting float switches in such prior systems is often exposed to corrosive and/or volatile liquids and/or gasses in the bilge. Such exposure often compromises the integrity of the electrical connections and/or wiring, resulting in system maintenance and operation problems. Such exposure can also subject the vessel to fire and explosion hazards.

Another problem is that the water level detection and control circuitry in such prior systems typically involves relatively high amperage electrical transmission, in the event of damage to the wiring insulation in such systems, there is a risk of fire and/or explosion due to the possibility of spark ignition of gases in the bilge.

SUMMARY OF THE INVENTION

Accordingly, it is a general object of the present invention to provide an improved bilge water level monitor, alert and control system for boats and other vessels.

It is another object of the present invention to provide a method of and apparatus for detecting excessive leakage of water into the bilge of a sea vessel and, in response to excessive water in the bilge, triggering an alarm to notify the operator or others.

It is another object of the present invention to provide an improved bilge water monitor, alert and control system for boats and other vessels that provides means for reducing the likelihood of exhausting battery power in the event of a significant seawater leakage problem.

It is another object of the present invention to provide an improved bilge pump monitor and alert system for boats and other vessels in which switching to manual operation of the pump does not de-energize the automatic switch and the alarm/monitoring system.

It is another object of the present invention to provide an improved bilge pump monitor and alert system for boats and other vessels in which the electrical power rating of the monitoring circuitry components is relatively low, thereby reducing the size (footprint and/or volume) and weight of those components relative to prior bilge pump monitoring and alert systems.

It is another object to provide a variation of the present invention having a remote monitoring and control system, including a manual pump "on" switch located remotely from the vicinity of the pump, itself, wherein the full electrical power flowing from the battery to the pump does not flow through the remote on-off switch.

It is another object to provide a variation of the present invention in which the water level detection and control circuitry operates with sufficiently low amperage to substantially eliminate the hazard of spark-induced combustion, even in the event of circuitry wiring damage in the vicinity of the bilge.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature and not as restrictive.

REFERENCE NUMERALS IN DRAWINGS

Figure 1:
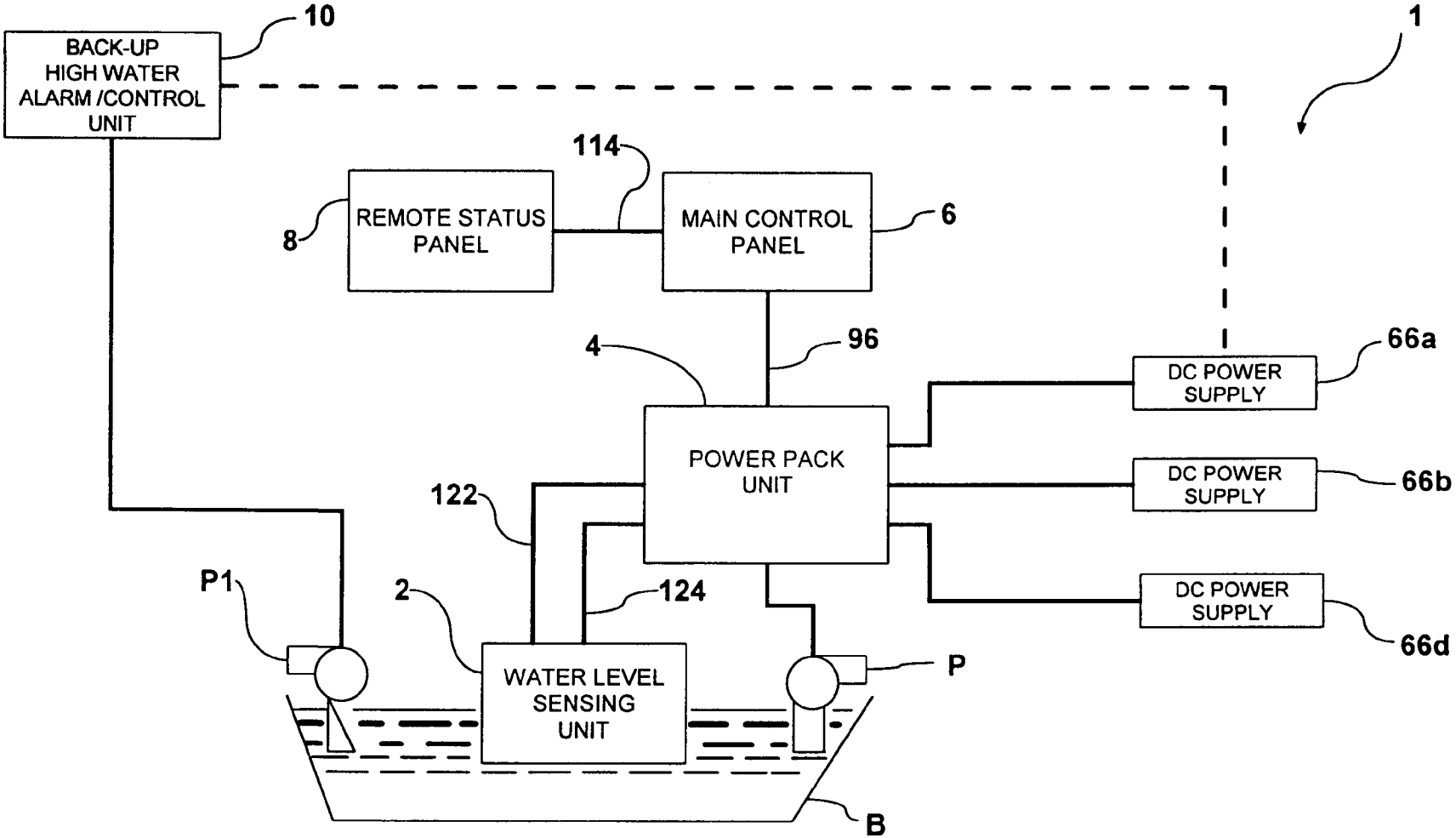
FIG. 1 is a schematic diagram showing a bilge water level monitor, alert and pumping system for boats and other vessels in accordance with one embodiment of the invention.

8 Bilge
P Pump
P1 back-up Pump
1 Monitoring System
2 Water revel sensing assembly
4 Power Pack Unit
6 Main Control Panel
8 Remote Status Panel
10 Back-up High Water Alarm and Control Unit
12 Low water level sensing unit
14 High water level sensing unit
16 Housing, water level sensing

16*a* Housing bottom portion
16*b* Housing side wall
20 Float chamber
20*a* Float chamber, interior to slosh guard
22 Sidewall, float chamber
24 Bottom partition, float chamber
26 Slosh guard/filter
28 Opening, float housing
30 Opening, float chamber bottom partition
32 Opening, float chamber sidewall
32*a* Opening, float chamber sidewall
34 Float
36 Reed switch
38 Wire, reed switch
40 Sealed jacket, reed switch wire
42 Top partition, float chamber
44 Air vent, float chamber top partition
46 Air chamber
48 Sidewall, air chamber
50 Opening, air chamber sidewall
52 Top wall, air chamber
54 Opening, air chamber top wall
55 Hose bib
58 Bracket! water level sensing assembly
60 Hose
62 I-lousing, power pack
64 Logic and control circuitry, power pack
66 DC Power Supply
68 Power Input Terminal
70 First Relay
70*a* Negative coil terminal, First Relay
70*b* Positive coil terminal. First Relay
70*c* Switch terminal, First Relay
70*d* Switch terminal, First Relay
71 Second Relay
71*a* Negative con terminal, 2na Relay
71*b* Positive coil terminal, $2^{nd}$ Relay
71*c* Switch terminal! $2^{nd}$ Relay
71*d* Switch terminal. $2^{nd}$ Relay
72 First Timer Switch
73 Second Timer Switch
74 Power Output Terminal
76 Ground Terminal
76*a* Ground Terminal auxiliary
78 Diode Pack
80 Power Supply Bus
64 Ground Circuit, Relay
86 Connection, pump ground circuit
88 Fuse, ground circuit
90 Switch, auto-manual
92 Face plate, main control panel
94 Housing. Main control panel
96 Harness, wiring, main control panel
98 Port, wiring harness, main control panel
100 Light. Auto
102 Light, _Manual
104 Light, Check Bilge
106 Light, Pump On"
108 Power Port
112 Alarm
114 Wiring Harness, remote status panel
116 Port, remote status wiring harness
118 Port, high water sensor wiring harness
120 Port, low water sensor wiring harness
122 Wiring Harness, high water sensor
124 Wiring Harness, low water sensor
126 Manual Switch, on-site
126 Redundant high water level sensing unit
150 DC Power Supply
151 Diode Pack
152 Main Power Bus
153 First Action Float Switch
154 tow Float On Light
155 Second Action Float Switch
156 System on-off switch
157 First Alarm
158 Second Alarm
159 Relay
160 Ground bus
161 Power Output Terminal
162 Diode
163 Manual Switch
164 Power Available Light
165 "Float Signal Initiated Light
166 Auxiliary output terminal
167 Auxiliary Alarm Power Supply
168 Diode
169 Spacer
170 Wiring harness, main control panel
180 Threads

DETAILED DESCRIPTION OF A PREFERRED EMBODIMENT

Figure 18:
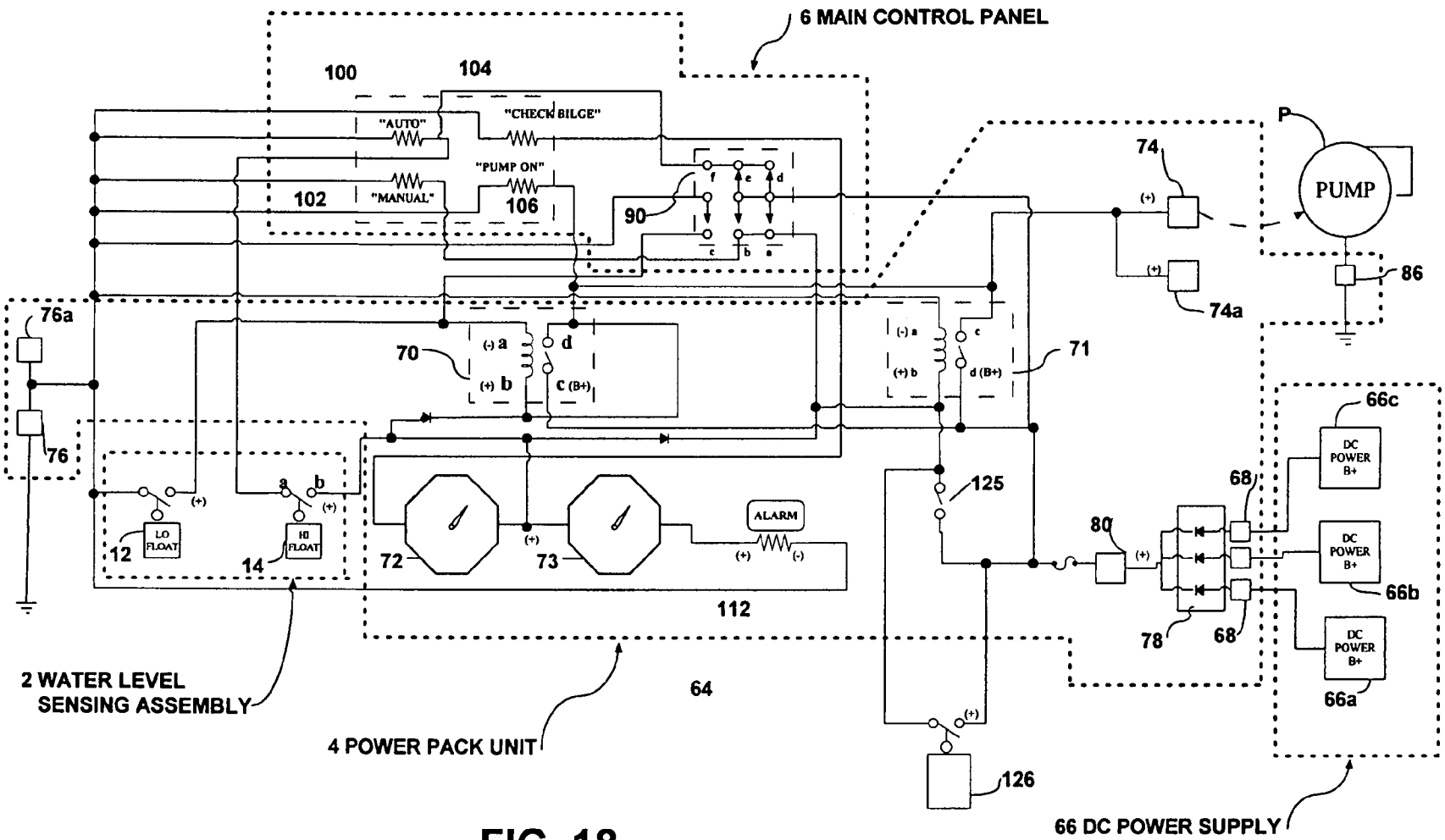
FIG. 18 is a schematic diagram of the bilge water level monitor, alert and pumping system shown if FIG. 8, with the system's major sub-components demarcated; and, FIG. 19 is a schematic diagram of the bilge water level monitor, alert and pumping system shown in FIG. 18, including connection of the remote status panel.

Referring to FIGS. 1 and 18, a bilge water level monitoring, alerting and control system (generally designated 1 in the drawings and herein also referred to as the "Monitoring System") for boats and other vessels is described. The Monitoring System 1 generally comprises a water level sensing assembly 2 that is electrically connected to a power pack unit 4 and a main control panel 6. A remote status panel 8 is electrically connected to the main control panel 6. Means are provided for connecting the power pack unit 4 to one or more external DC power supplies 66 and to one or more external pump(s) (P). In a modified embodiment of the invention an optional back-up alarm unit 10 is also electrically connected, (either directly, as shown in FIG. 1. or indirectly via the power pack unit 4), to the DC power supply 66.

The Monitoring System 1 provides means to monitor the level of water in the bilge (B) of a vessel, to activate one or more pumps (P) for the removal of such water from the bilge (B), and other functions as described herein below.

The water level sensing assembly 2 (shown schematically in FIG. 2) comprises a low level sensing unit 12 and a high level sensing unit 14, which communicate the water level status of the bilge (B) to the power pack unit 4.

The power pack unit 4 houses electrical logic and control circuitry 64 for the Monitoring System 1. The power pack unit 4 is adapted to be connected to a DC power supply 66 and one or more pumps (P). In response to predetermined conditions (as will be described more fully herein below), the power pack unit 4 turns the pump (P) on in order to remove water from the bilge (B).

The main control panel 6 is preferably connected directly to the power pack unit 4, in the vicinity of one of the control stations of the vessel—As will be described more fully herein below, the main control panel 6 may additionally be used to manually turn on the pump (P). The main control panel 6 is also used to monitor (for example! by way of observation of lighted displays and/or audible alarms that are responsive to signals from the power pack 4) the water level status in the bilge (B) as well as the operational status of the pump (P).

A remote status panel 8 is electrically connected (via wiring harness 114) to the main control panel 6 and is preferably located remotely from the vicinity of the bilge (B). for example at a secondary control station of the vessel or other area of interest—The remote status panel provides means for monitoring the operational status of the pump (P) and bilge pump activity from a remote location, such as from the bridge of the vessel.

Water Level Sensing Assembly 2

Figure 2:
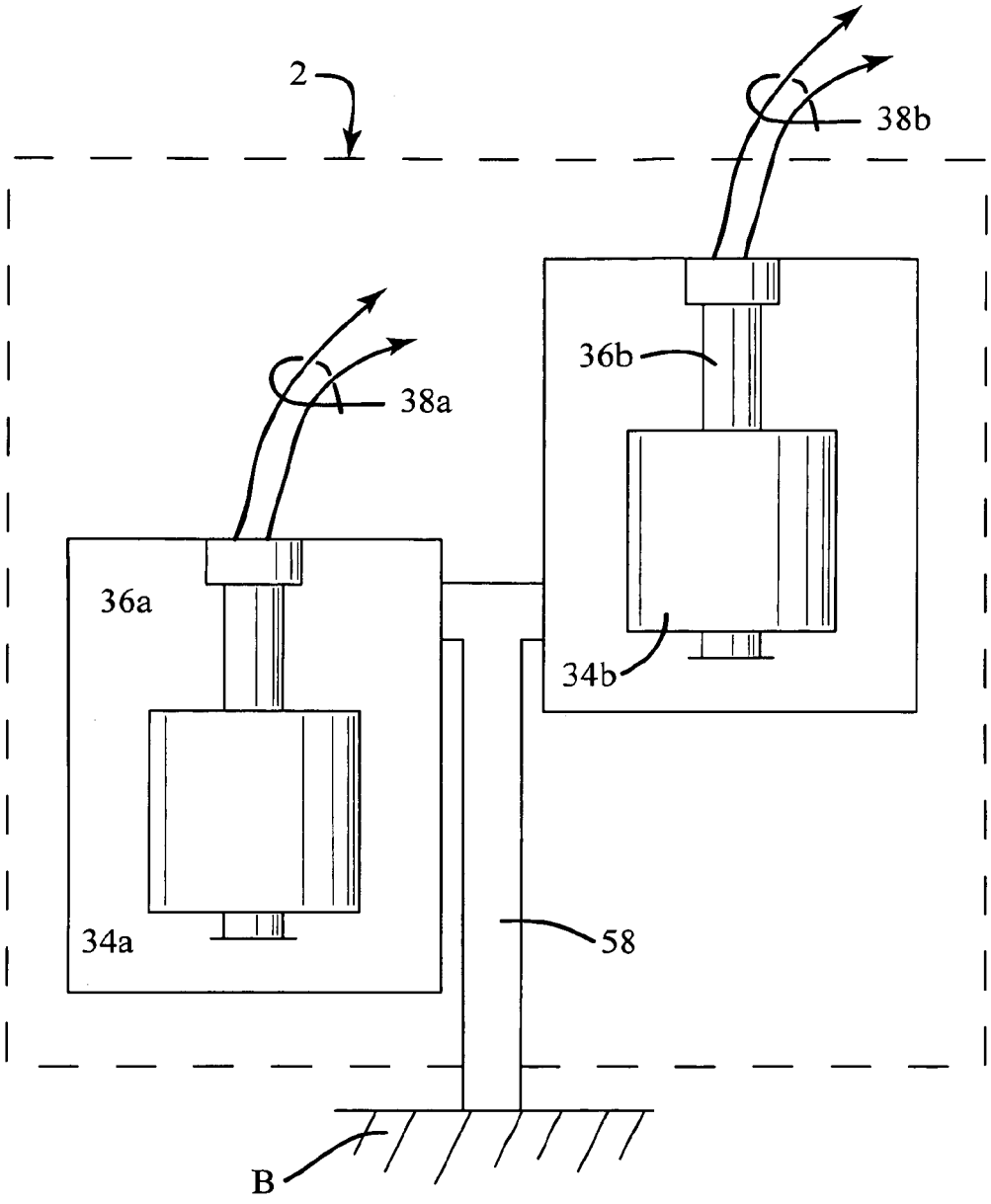
FIG. 2 a schematic side elevation showing the relative positions of the high level float sensor unit and the low level float sensor unit in accordance with one embodiment of the invention.
Figure 3:
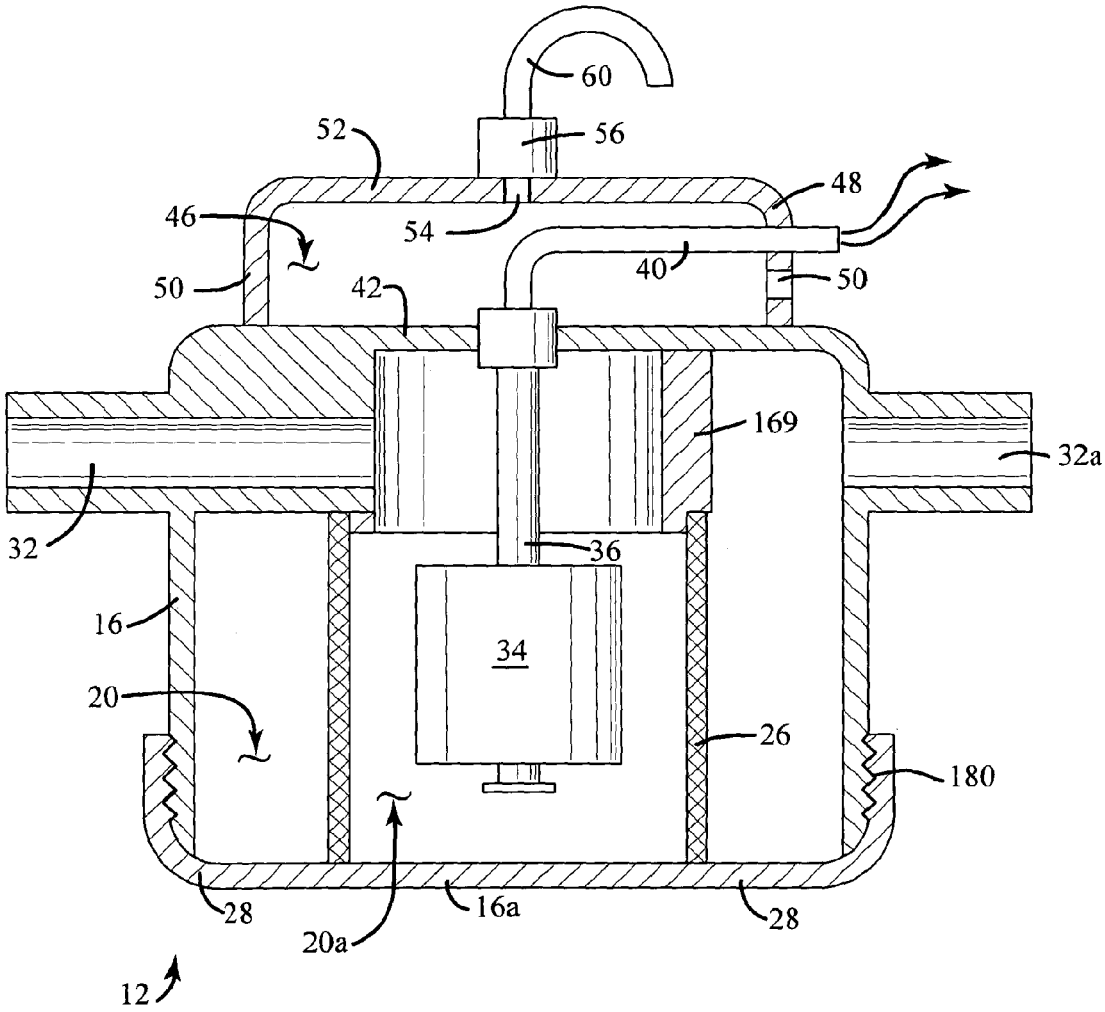
FIG. 3 is a medial cross-sectional elevation of a float sensor unit constructed in accordance with one embodiment of the invention.

Referring to FIGS. 2 and 3: The water level sensing assembly 2 comprises a low level sensing unit 12 and a high level sensing unit 14, In the preferred embodiment of the invention, construction of the low and high level sensing units 12 and 14, respectively, are substantially identical. In the preferred embodiment of the invention the low level sensing unit 12 and the high level sensing unit 14 are mechanically supported, for example from a bracket 58 that is adapted to be secured to the structure of a boat, such that the low level sensing unit 12 is at a lower elevation than the high level sensing unit 14 when the water level sensing assembly is operationally installed in the bilge (B) of a boat.

As shown in FIG. 3, the low level sensing unit 12 (as well as the high level sensing unit 14) preferably comprises a housing 16 having an internal float chamber 20 and an air chamber 46—A housing bottom portion 16*a* is at the bottom of the float chamber 20. A float chamber top partition 42 separates the float chamber 20 from the air chamber 46.

Openings 28 are provided in the bottom 16*a* of the housing to allow bilge water to enter the float chamber 2D from outside of the housing 16. A slosh guard/filter 26 is preferably provided inside the float chamber to minimize rapid, erratic motion of bilge water inside of the housing 16 during operation. In the preferred embodiment of the invention, the slosh guard/filter 26 is held in place with a cylindrical spacer 169, which protrudes downwardly from the top partition 42. Preferably the slosh guard/filter 26 comprises a fine mesh screen, in the form of a cylinder that extends from the housing bottom portion 16*a* to the cylindrical spacer 16*g*. The screen mesh construction of the slosh guard/filter 26 additionally serves to filter water-borne particulates away from the central portion 20*a* of the float chamber 20 during operation. In the preferred embodiment of the invention, threads 160 are provided for removeably attaching the housing bottom portion 15*a* to the housing side wall 16*b*. By manually unscrewing the housing bottom portion I 6*a* from the housing side well 16*b*, access is gained into the float chamber 20 for removal of debris and servicing the slash guard/filter 26 and other interior components of the sensing unit 12. Openings 28 are provided in the housing 16, (preferably in the bottom portion of the housing 16*a*), to allow bilge water to enter into the float chamber 20 from outside of the housing 16 during operation. Preferably, the openings 28 are all countersunk upwardly (as shown in FIG. 3) to facilitate self-cleaning of debris from the openings 28, away from the float chamber 20. The size (i.e., diameter) of the openings 28 controls the rate at which bilge water can fill the float chamber 20.

Disposed within the float chamber 20 is a sealed reed switch 36, comprising a vertically slidable float member 34. The float member 34 is preferably located approximately on a vertical centerline of the float chamber 20, so as to minimize the effect on the float of rocking by the boat during operation. A pair of wires 38, electrically connected to opposite electrical contacts of the reed switch 36, extends from inside the float chamber 20, through a water-tight opening in the float chamber top partition 42, then through the air chamber wall 48 to the exterior of the housing 16. A sealed jacket 40 is provided on each of the reed switch wires 38, to provide protection and to isolate wires from potentially high bilge water. By design, in normal operation, reed switch wiring 3ö snot exposed to bilge water. This reduces or eliminates the potential for electrical current leakage into the water and potential arcing from deteriorated wiring. Such arcing could be an ignition source in an explosive environment.

Figure 5:
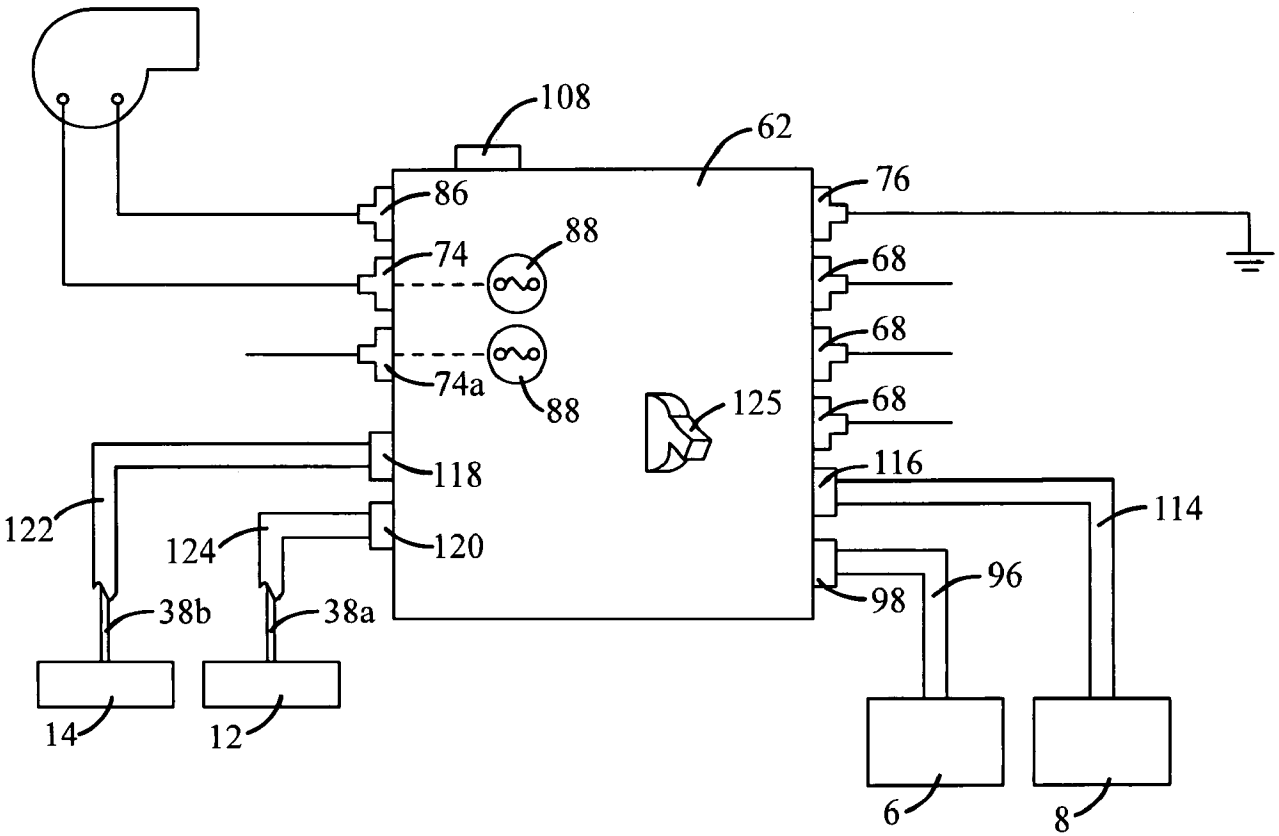
FIG. 5 is a schematic view of the outside of the housing of the power pack unit and peripheral electrical components connected thereto in accordance with the present invention.

Referring now to FIGS. 2 and 5: When in operation, the float member 34 floats upwardly, and closes the reed switch 36, whenever bilge water rises to a predetermined elevation inside the float chamber 20. The reed switch wires (via wiring harnesses 122 and 124) electrically connect the reed switch to harness ports 118 and 120, respectively, at the power pack unit 4, As will be described more fully herein below, operation of one or more bilges pump (P) is controlled, in part, in response to the opening and/or closing of the reed switches 36 of the low and high water level sensing units 12 and 14, respectively.

Referring now to FIG. 3: Openings 32 and 32*a* are provided in the sidewall 16*b* of the housing from the exterior of the housing into the float chamber 20. The openings 32 and 32*a* are preferably located approximately at an elevation corresponding to the elevation at which the water inside of the float chamber would, during operation, cause the float 34 to close the reed switch 36. These openings 32 are provided to allow high water to enter into the float chamber 20 even in the event that all of the openings 28 in the bottom portion 16*a* of the housing become clogged up with debris. In the preferred embodiment of the invention, opening 32*a* extends from the exterior of the housing 16 directly into the float chamber 20, exterior to the slosh guard/filter screen 26; and opening 32 extends from the exterior of the housing 16 into the float chamber 20*a*, interior to the slosh guard/filter screen 26. This provides additional operational safety for the device because, in the event that the slosh guard/filter screen 26 becomes clogged up with debris, bilge water may still enter into the float chamber interior 20*a* via opening 32.

An air vent 44 is provided in the float chamber top partition 42, to allow air to vent from the float chamber 20 to the air chamber 46 as the water level rises inside of the float chamber 20 during operation.

Openings 50 are located in the sidewall 48 of the air chamber 46, just above the float chamber top partition 42. These openings 50 allow air from the air chamber 46 to be vented from the air chamber 46 (into the in bilge air space) as water enters the float chamber 20 during normal operation.

In the event that water enters into the bilge (B) faster than the pump (P) can remove it, the water level inside the housing 16 may rise to fill the float chamber 20~ and the water level may continue to rise, passing through the air vent 44 into the air chamber 46. If the water continues to rise to an unusually high elevation such that the water revel is above the openings 50 in the sidewall 46 of the air chamber 46, air between the surface of the water in the air chamber 46 and the top wall 52 of the air chamber is directed out of the air chamber 46 via top vialr opening 54. In the preferred embodiment of the invention a hose bib 56 is attached to the air chamber top wall opening 54 for connection of one end of a pneumatic hose 60, through which air can be vented to the outside, The second end of the pneumatic hose 60 may be Left unattached, in which case it is preferable that it be aimed downwardly (as shown in FIG. 3) to prevent debris from settling (and clogging) either on the hose 60 or the opening 54, The second end of the hose 60 may alternatively be connected to a pneumatic switch (not shown), which could, in turn, be in communication with a back-up pump or alarm.

Construction and operation of the high water level sensor unit 14 is similar to that of the low water sensor unit 12, as shown in FIG. 3.

It will be understood that, because the high water level sensor unit 14 (more particularly, the float/switch 34*a*/36*a* therein) is operationally positioned inside the bilge (B) at a higher elevation than the low water level sensor unit 12 (or more particularly, the float/switch 34*b*/36*b* therein), the reed switch 36*a* in the low water revel sensor unit 12 will normally close before the reed switch 36*b* in the high water level sensor unit 14 closes during a period of rising water level. Conversely, during normal operation, the high water lever sensor unit 14 opens before the low water level sensor unit 12 opens during a period of falling water level.

The housings 16 of the low and high water level sensing units 12 and 14, Respectively, can be separated for unique applications or can be adjusted on a common mount for tailored bilge pump activity.

Figure 16:
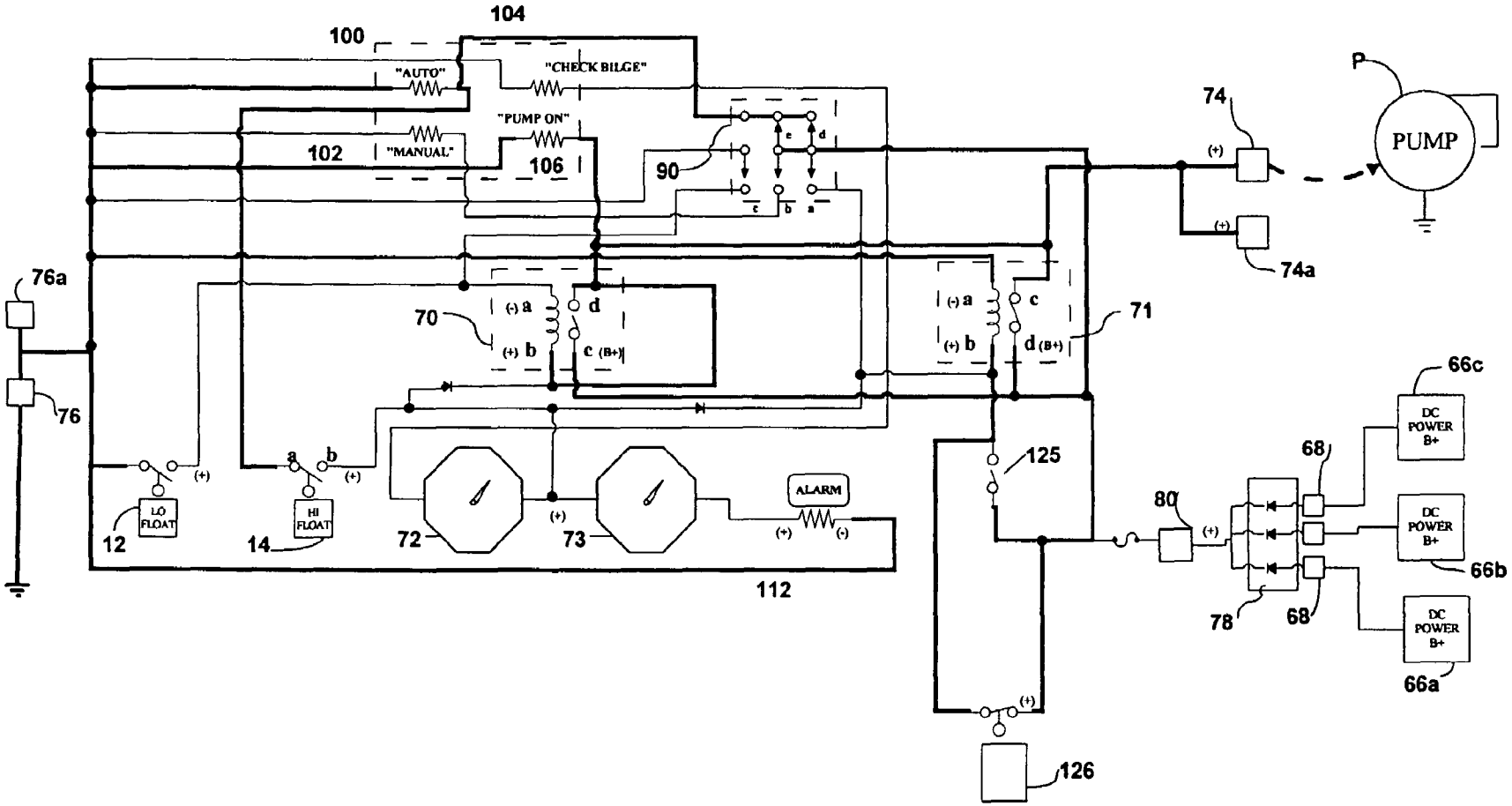
FIG. 16 is a schematic diagram of the bilge water revel monitor, alert and pumping system shown in FIG. 8, shown with the remote switch in the "automatic" position and with a back-up" float switch in the closed position.

Power Pack Unit 4,

Referring now to FIGS. 5 and 16: The power pack unit 4 responds to signal input to control bilge pump (P) function.

In the preferred embodiment of the invention, the power pack unit 4 comprises a housing 62 which encloses the power pack Logic and control circuitry 64.

Multiple power (B+) input terminals 68 are provided to facilitate simultaneous connection of the power pack unit 4 to multiple DC power supplies, for example batteries 66*a*, 66*b* and 65*c*, It will be understood that, while the present description illustrates the construction and operation of the invention while connected to three DC power sources (e.g., batteries 66*a*, 66*b*, 66*c*), it is within the scope of the invention to provide the power pack unit 4 with any multiple number of power input terminals 68.

Heavy Duty studs are provided for the electrical power supply terminals 68 and power output terminals 74, 74*a* (for bilge pump connections) and for the ground terminals 76, 76*a*.

In the preferred embodiment of the invention a diode pack 78 (comprising one diode in series with each input terminal 68. respectively) is connected to the power input terminals 66 to isolate the batteries for multiple power source connections, as desired by the operator.

Referring to FIG. 5: Harness ports 118 and 120 are provided in the housing 62 of the power pack unit 4 for connection wiring harnesses 122 and 124, respectively, from the high water level and low water lever sensing units 14 and 12, respectively. In addition, harness port 98 is provided in the housing 62 of the power pack unit 4 for connection of wiring harness 96 from the main control panel. A remote status panel 8 may be connected directly to power pack unit 4. Harness port 116 is provided in the housing 62 of the power pack unit 4 for optional connection of wiring harness 114 from the remote status panel for this embodiment of the invention, as shown in FIG. 5.

Figure 6:
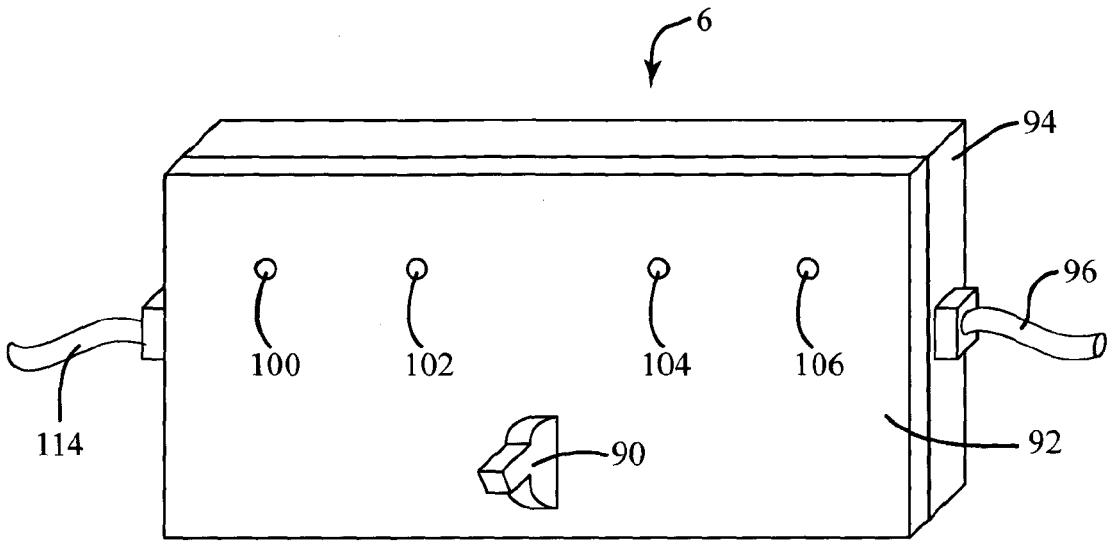
FIG. 6 is a perspective view of a main control panel constructed in accordance with an embodiment of the invention.
Figure 19:
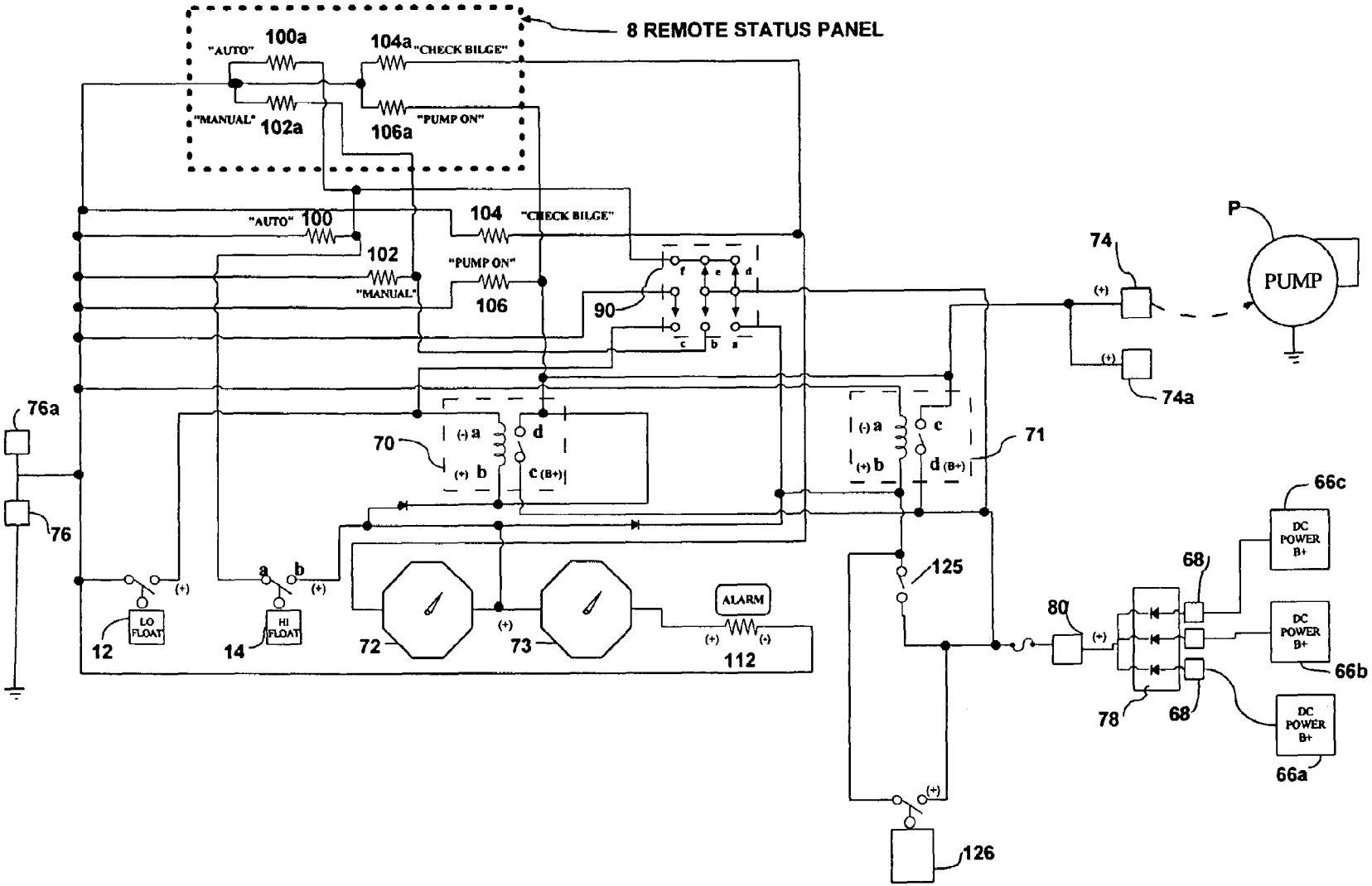

In the preferred embodiment of the invention, however, a remote status panel 8 is connected to the main control panel 6 (rather than being connected to the power pack unit I through wiring harness 114, as shown in FIGS. 1, 6 and 19.

The reed switch 36*a* of the low water level sensing unit 12 is electrically connected between the ground stud 76 of the power pack unit 4 and the (low current) negative coil terminal 70*a* of the first relay 70.

The reed switch 36*b* of the high water level sensing unit 14 is electrically connected between the power supply bus 60 and the (low current) positive coil terminal 70*b* of the first relay 70. The reed switch 36*b* of the high water level sensing unit 14 is also electrically connected between the power supply bus 80 and the positive coil terminal 71*b* of the second relay 71.

Figure 8:
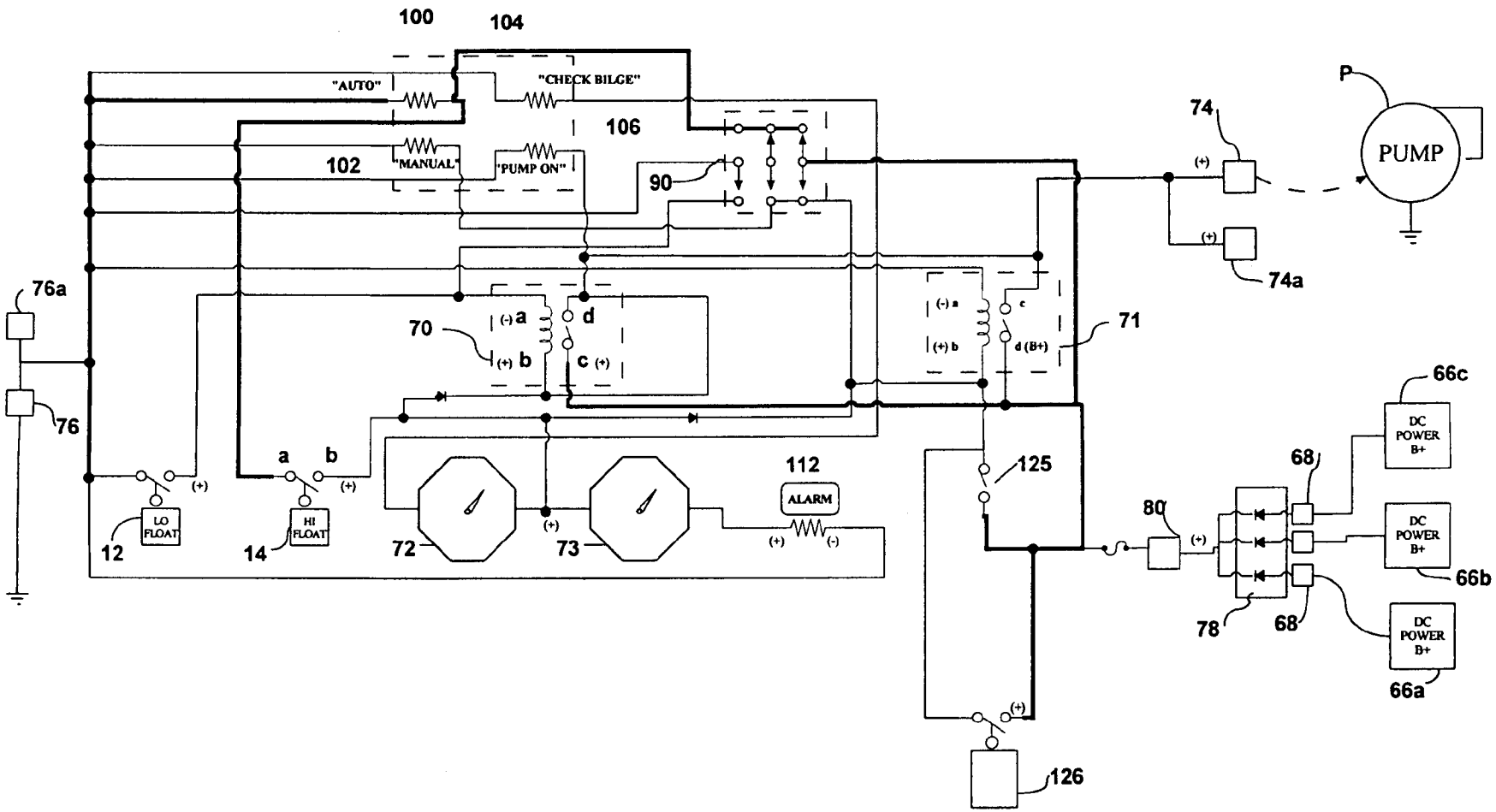
FIG. 8 is a circuit diagram of a bilge water level monitor, alert and pumping system in accordance with an embodiment of the invention; and, FIGS. 9-14 are schematic diagrams of the bilge water level monitor! alert and pumping system shown in FIG. 8, shown in various stages of automatic operation.

Reed Switches, Timers and Relays Operation (FIGS. 8-14):

Referring now to FIG. 8: During normal operation, power pack unit switch 90 is set to the ~Automatic~ position. When the water level in the bilge (B) is below a predetermined level, both of the float switches of low water level sensing unit 12 and the high water level sensing unit 14 are open. Because the switch of the low water level sensing unit 12 is open, the circuit to the negative coil terminal 70*a* of the first relay 70 is open, thus causing (allowing) the first relay 70 switch to be open, thereby interrupting the positive power path from the power supply bus 80 through the first relay 70 and to the power output terminal 74. Also, because the switch of the high water level sensing unit 14 is open, the circuit to the positive coil terminal 71*b* of the second relay 71 is open, thus causing (allowing) the second relay 71 switch to be open, thereby interrupting the positive power path from the power supply bus 80 through the second relay 71 and to the power output terminal 74. Thus, it will be understood that, with the water level in the bilge below a minimum level, there is no positive voltage supplied to the power output terminal 74, and, therefore, the bilge pump (P) connected to the power output terminal is "OFF".

Figure 9:
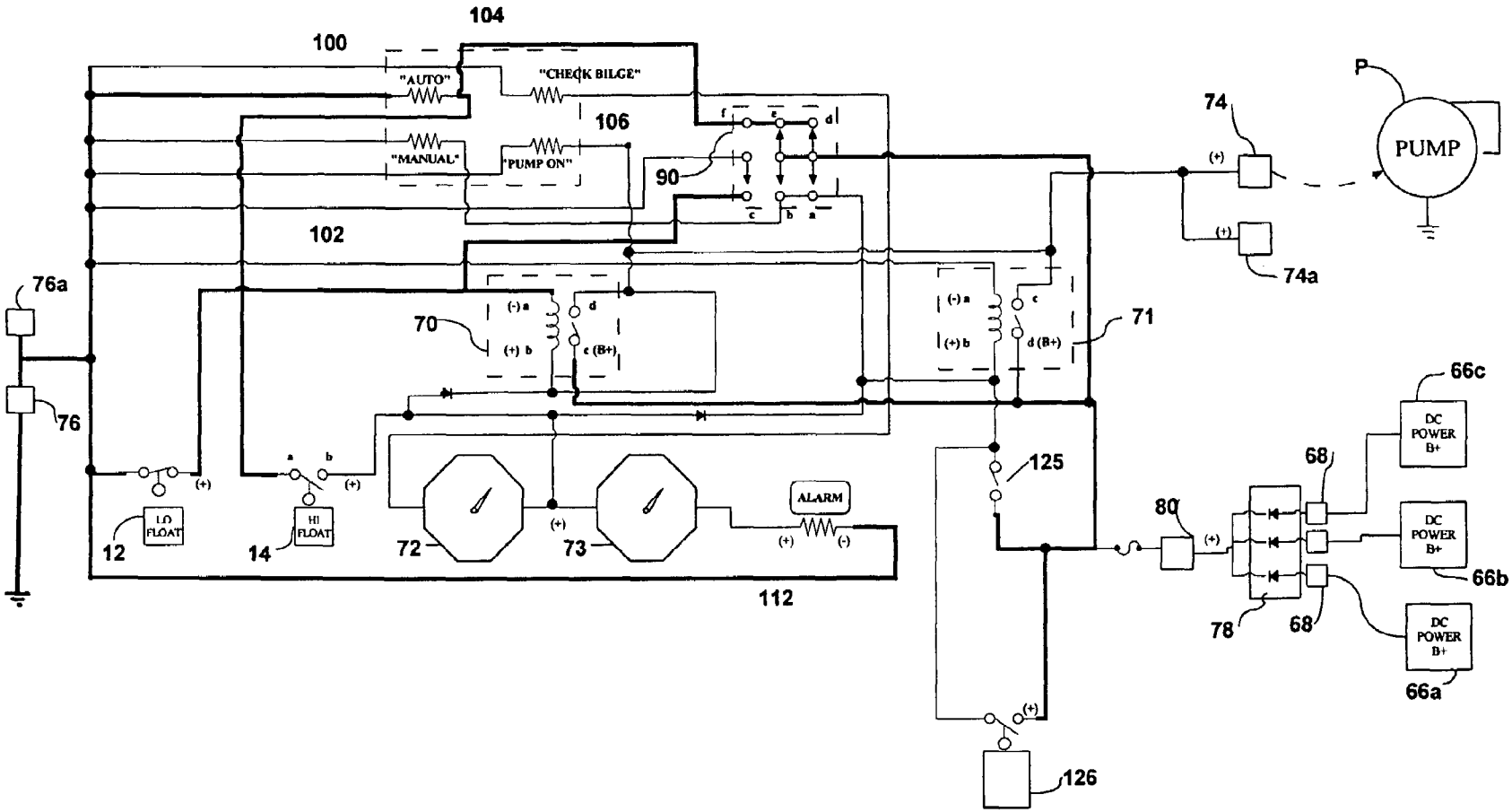

Now referring to FIG. 9: As the water level in the low water level sensing unit 12 assembly 2 begins to rise, the low level reed switch 36*a* closes, thereby closing the ground circuit to the negative coil terminal 70*a* of the first relay 70, However, because the water level in the high water level sensing unit is not (yet) high enough to cause the high level reed switch 36*b* of the high water sensing unit 14 to close, the circuit from the power bus, through the high water sensing unit 14, to the relay coil positive voltage terminal 70*b* remains open, thus causing (allowing) the first relay 70 switch to be stay open. Since the first relay switch 70 remains open, the positive power path from the power supply bus 80 through the first relay 70 and to the power output terminal 74 is interrupted, Similarly, because the switch of the high water level sensing unit 14 is open, the circuit to the positive coil terminal 71*b* of the second relay 71 remains open, thus causing (allowing) the second relay 71 switch to be remain open, thereby interrupting the positive power path from the power supply bus 80 through the second relay 71 and to me power output terminal 74, Thus, it will be understood that, with the (rising) water level in the bilge below a level that is high enough to close the switch 36*a* of the low water level sensing unit 12 switch, but too low to close the switch 36*b* of the high water level sensing unit 14, there is no positive voltage supplied to the power output terminal 74, and, therefore, the bilge pump (P) connected to the power output terminal is "off".

Figure 10:
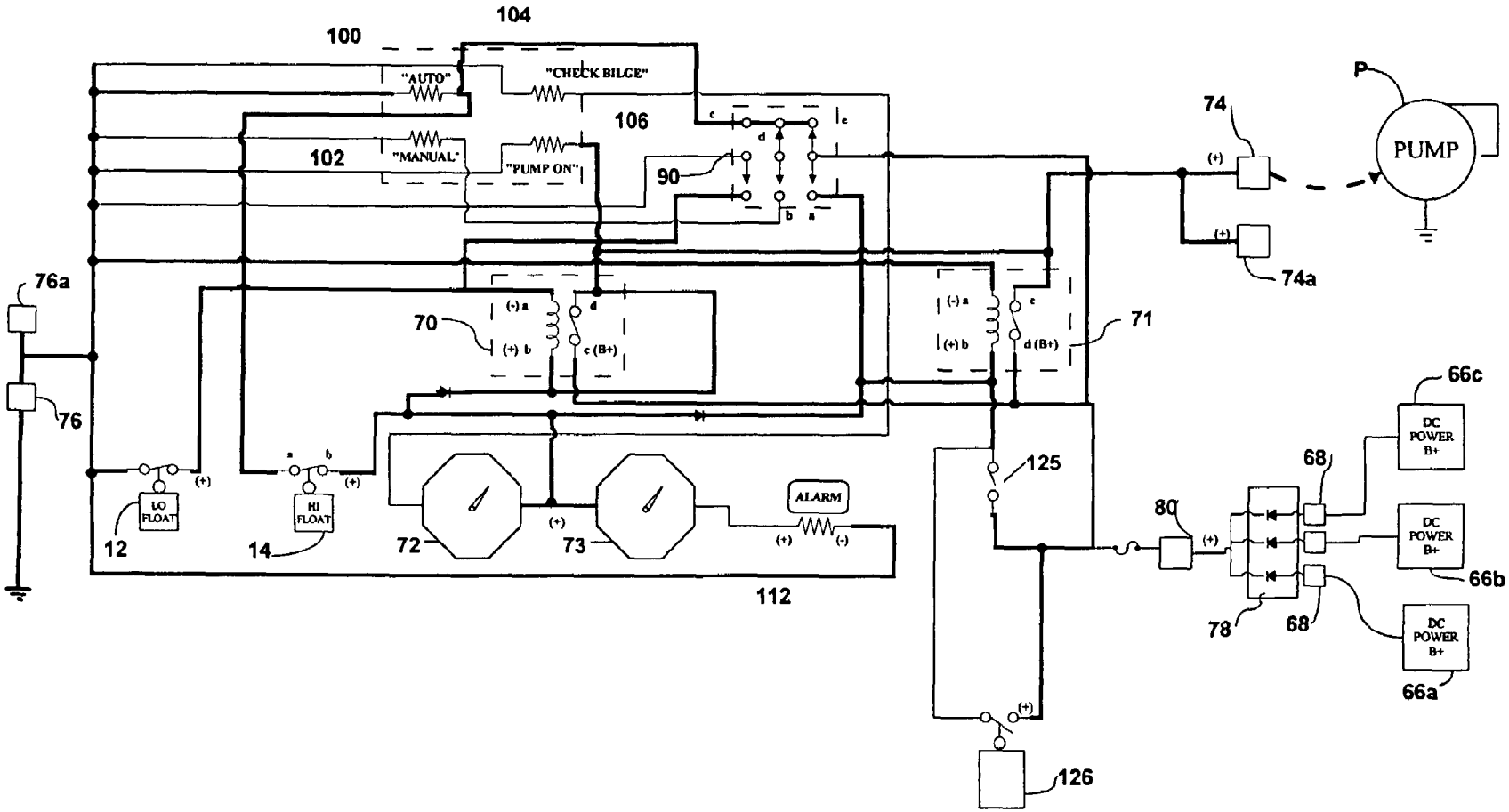

Referring now to FIG. 10: FIG. 10 illustrates the condition when the water level in the bilge (B) becomes high enough to cause the switches 36*a* and 36*b* of the low water level and high water level sensing units 12 and 14, respectively, to close. Closure of the switch 36*a* of the low water level sensing unit 12 completes the ground path from the ground terminal 76 to the negative coil terminal 70*a* of the first relay; and closure of the switch 36*b* of the high water level sensing unit 14 completes the positive voltage circuit from the power supply bus 80 to the positive coil terminal 70*b* of the first relay, thereby causing relay switch 70 to close. Closure of the first relay 70 switch completes the positive voltage path from the power supply bus 80. through the first relay 70 switch, to the power output terminal 74, thereby causing the bilge pump (P), which is connected to the power output terminal 74, to turn "on", Closure of the switch 36*b* of the high water level sensing unit 14 also completes the positive voltage circuit from the power supply bus 80, through the high water sensing unit 14, to the positive coil terminal $7^{Th}$ of the second relay. This causes the second relay 71 switch to close, providing a second positive voltage path (namely from the power supply bus 80, through the second relay 71 switch) to the power output terminal 74 and, thence, to the bilge pump.

Thus, it will be understood that under normal, "automatic", conditions, whenever the water level in the bilge (B) is high enough to close both switches 36*a* and 36*b* of the low water and high water level sensing units 12 and 14, respectively, voltage is supplied through relays 70 and 71 to the power output terminal 74, and the pump is turned on.

When the switch 36*b* of the high water level sensing unit 14 first closes, (and accordingly, completes the positive voltage path through the first relay 70 switch as described above), this also completes the positive voltage path (namely, from the power supply bus 80. through the high water level sensing unit 14) to the first 72 and second 73 timer switches. This causes the clocks of each of the timer switches 72 and 73 to start running, The first timer switch 72 is designed to close before the second timer switch 73 closes, In the preferred embodiment of the invention, the first timer switch 72 is set to close after running for 2 minutes, and the second timer switch 73 is set to close after running for 4 minutes, The particular time setting for each timer switch (72 and 73) should be selected in accordance with, and depending on, the capacity of the bilge, the capacity and number of pumps used, etc.

Figure 11:
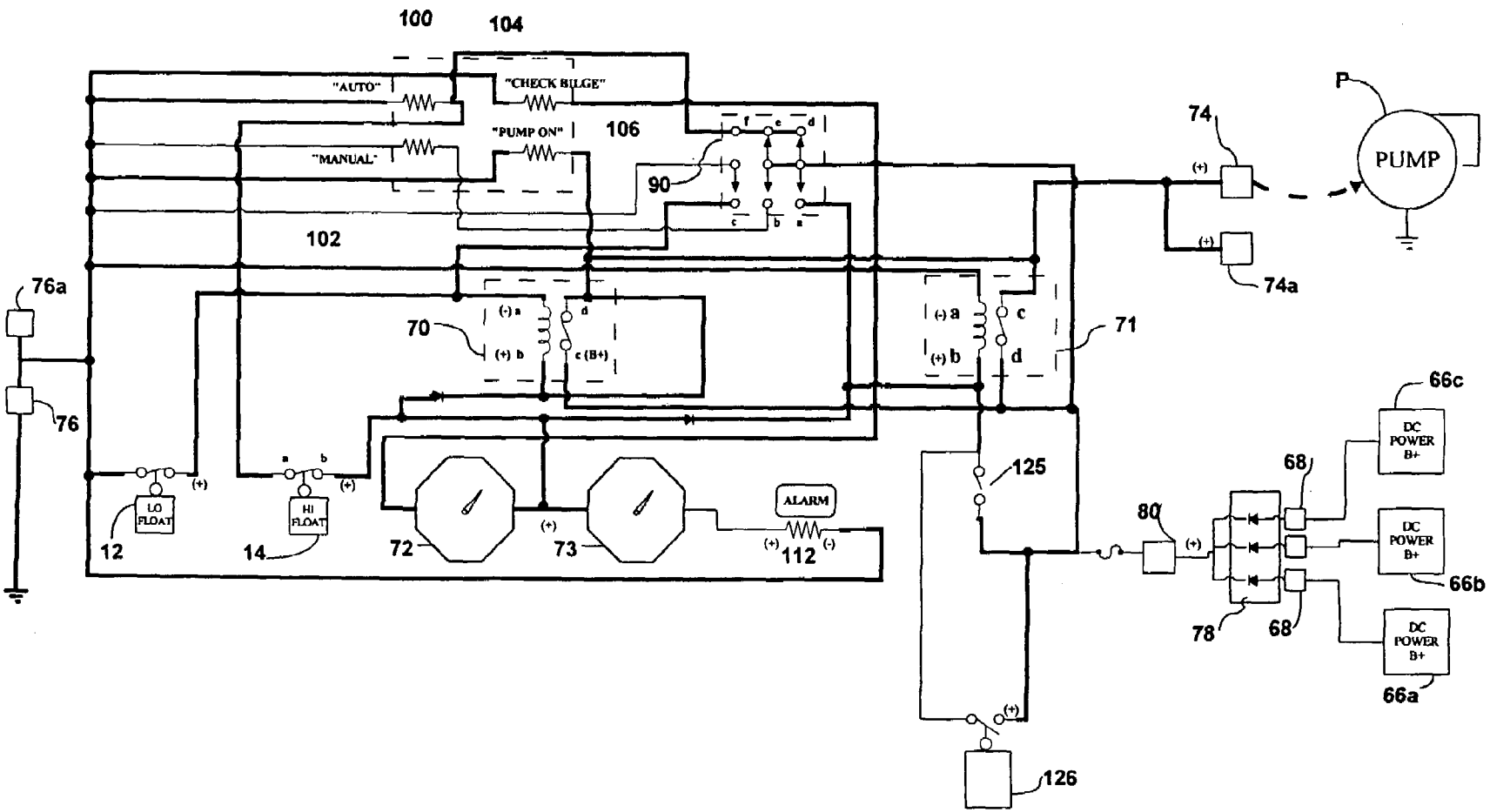
Figure 12:
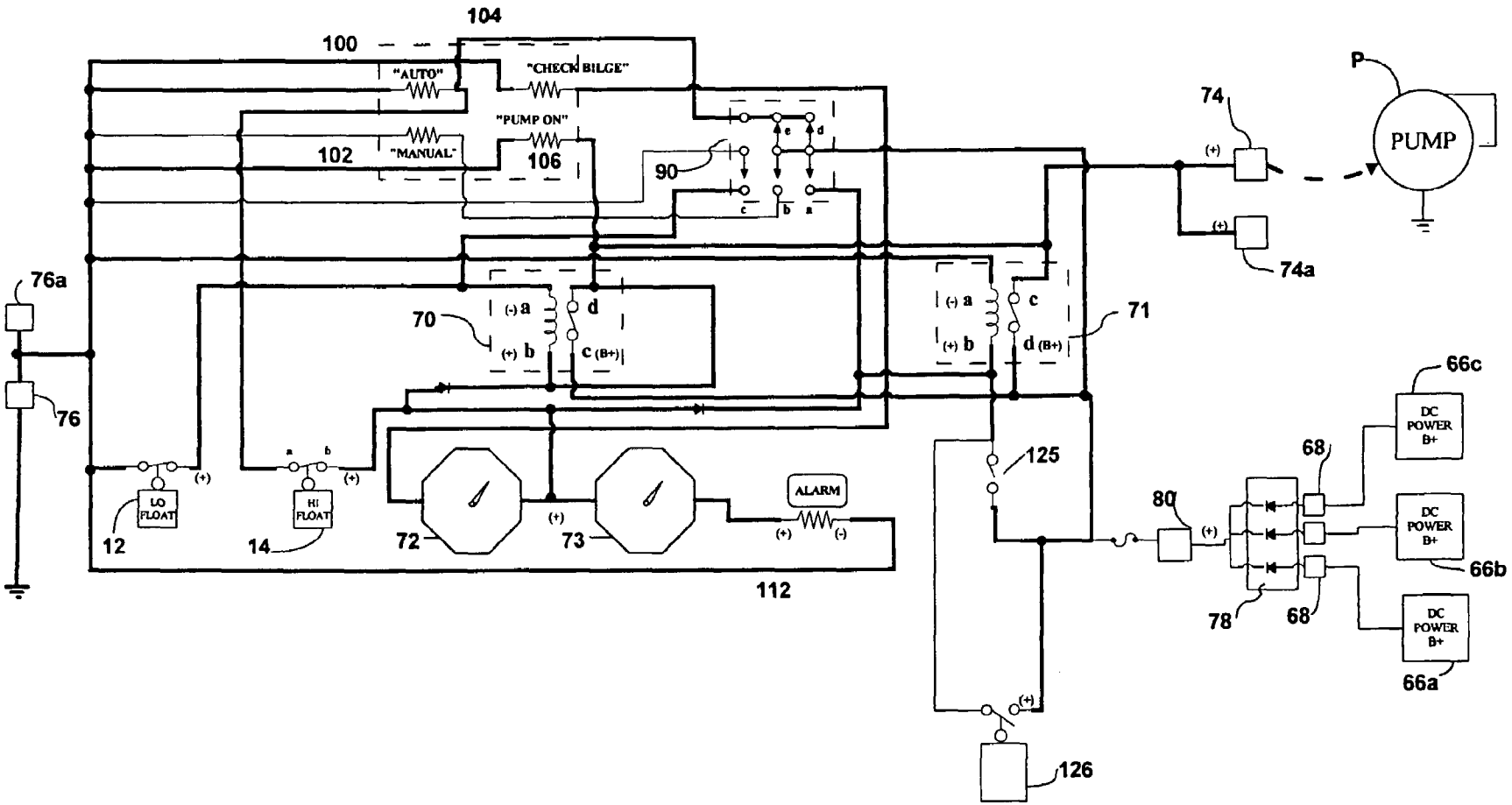
Figure 13:
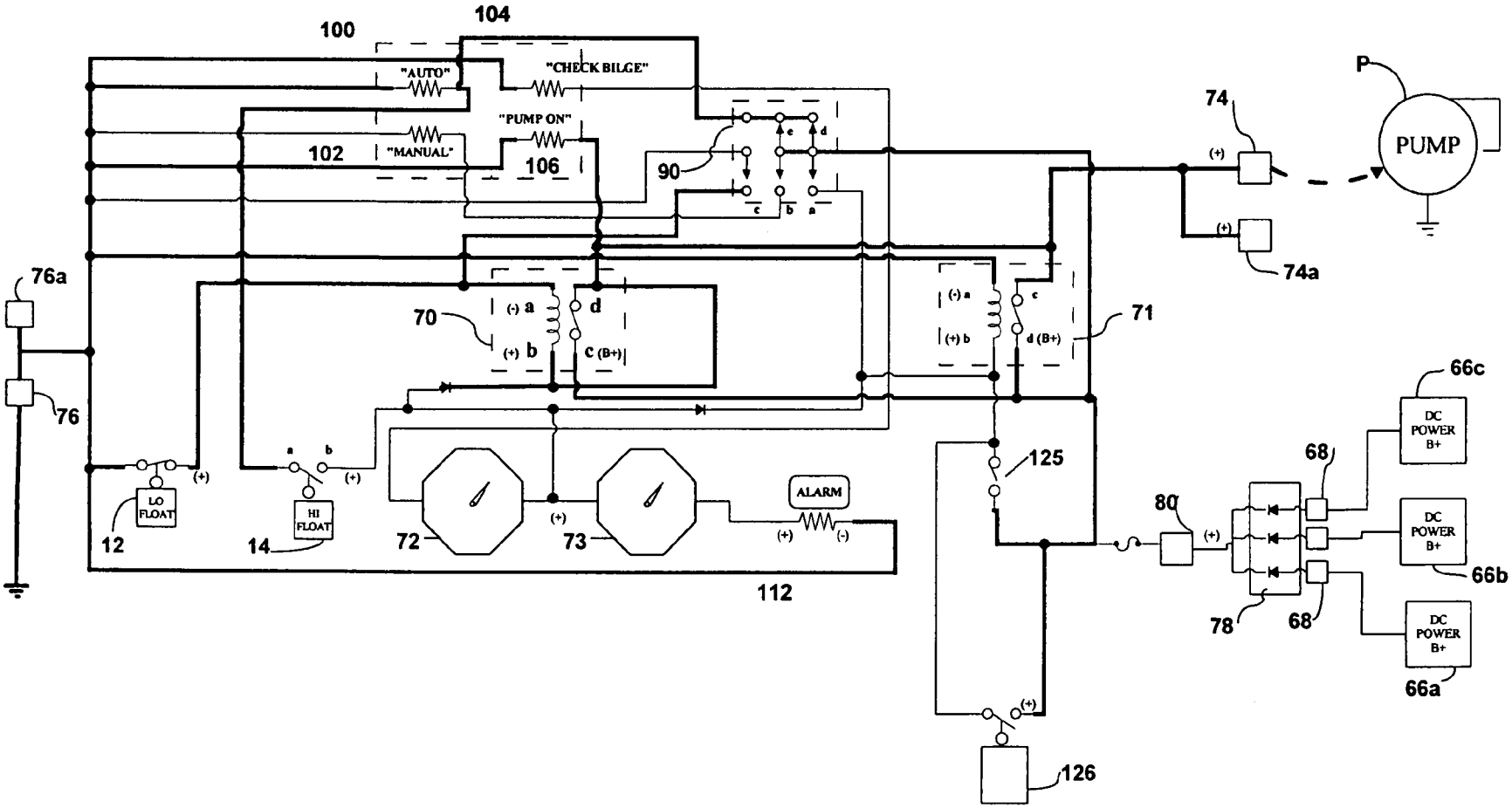

Referring now to FIG. 11: If the water level remains so high in the bilge that the switches (36*a* and 36*b*) of the high and low water sensing units 12 and 14, respectively, remain closed for more than 2 minutes, the first timer switch closes. This closure completes a positive power path to a "check bilge" light 104 located at the main control panel 6, and, therefore, the "check bilge" light 104 turns "on", Referring now to FIG. 12: If the water level remains so high in the bilge that the switches (36*a* and 36*b*) of the high and low water sensing units 12 and 14, respectively, remain closed for more than 4 minutes, the second timer switch 73 closes. This closure completes a positive power path to an alarm 112. causing the alarm 112 to turn on, The alarm 112 may be audible and/or visible. and may be physically located at the power pack unit 4 and/or remotely from the power pack unit 4, The first timer switch 72 remains closed, and the 'check bilge" light 104 continues to stay turned "on", Referring now to FIG. 13: Under normal operation, as the pump (P) discharges water from the bilge (B). the water level first falls to an elevation sufficiently low to cause the switch 36*b* of the high water level sensing unit 14 to open, but is not sufficiently low to open the switch 36*a* of the low water level sensing unit 12. When the switch of the high water level sensing unit opens, it interrupts the positive power path from the power supply bus 80 (through the high water level sensing unit 14 to the positive coil terminal 71*b* of the second relay 71.

This (opening of the high water level sensing unit 14) also interrupts the positive voltage path from the power supply bus through the high water level sensing unit 14 switch to the positive coil terminal 70*b* of the first relay 70. However, since relay switch terminal 70*d* and the positive coil terminal 70*b* of the first relay 70 are hard-wired to each other, when the first relay switch 70 previously closed (i.e., when the high water level sensing unit 14 was earlier closed) that completed a second, alternate, positive voltage path (from the power supply bus 80, to the first relay switch terminals 70*c* and 70*d*) to the positive voltage coil terminal 70*b* of the first relay. Since the switch 36*a* of the low water level sensing unit 12 remains closed, the negative coil terminal 70*a* of the first relay 70 remains grounded. Thus, an electric circuit through the coil terminals (70*a* and 70*b*) of the first relay 70, continues to exist and thereby causes the first relay 70 switch to remain closed, even when the switch of the high water lever sensing unit 14 is open. With the first relay 70, switch still closed. a positive voltage path is still completed from the power supply bus 80 through the first relay 70 switch terminals 70*c* and 70*d*, to the power output terminal 74, thereby allowing/causing the pump (P) to remain "on".

Figure 14:
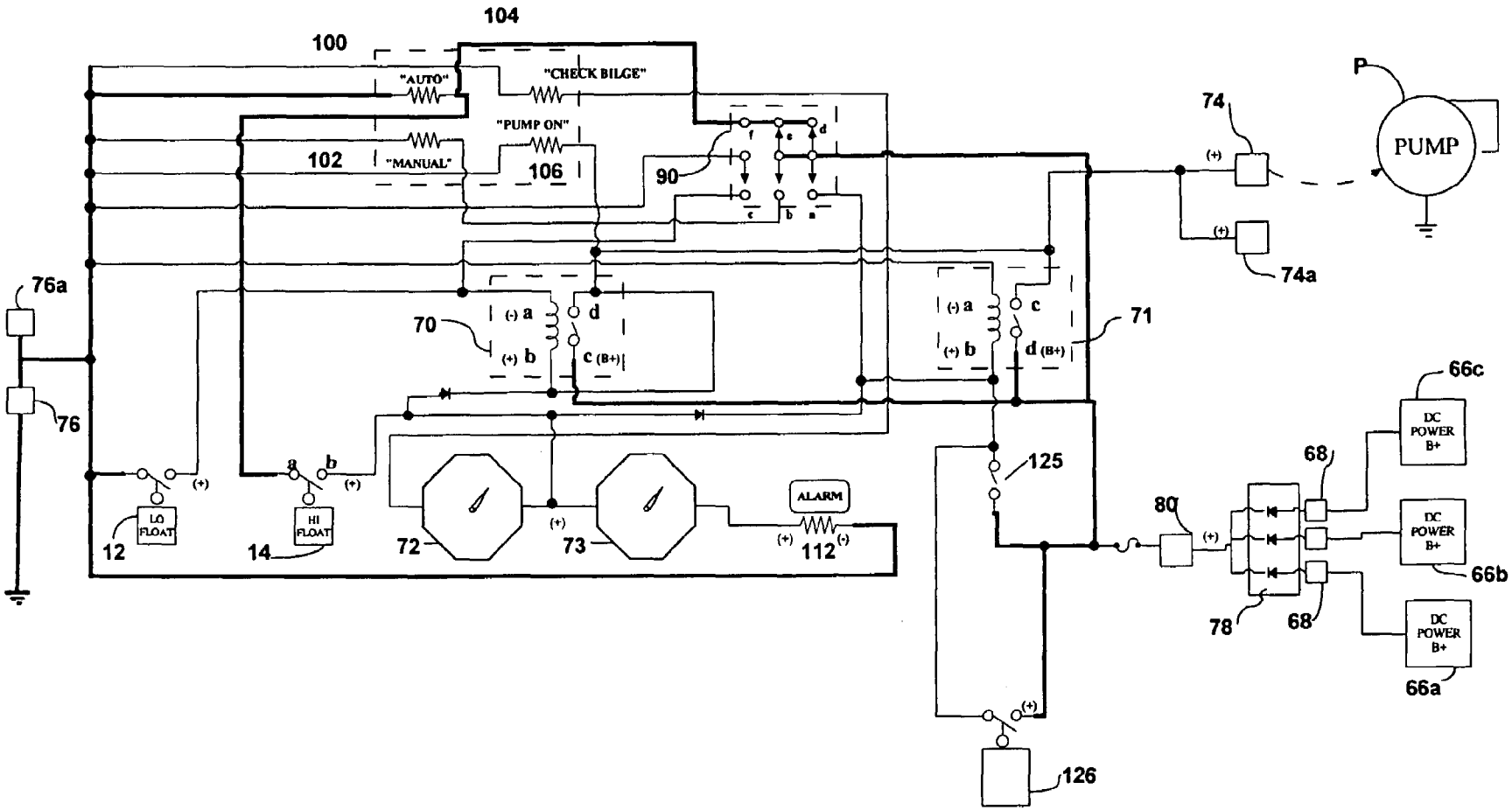

Referring now to FIG. 14: As the pump (P) continue to discharge water from the bilge, the water level falls until the switch 36*a* of the low water level sensing unit 12 opens. Opening of the switch 36*a* of the low water level sensing unit 12 interrupts the ground path (from the ground terminal 76, through the low water level sensing switch unit 12) to me negative coil terminal 70*a* of the first relay 70, Since the negative coil terminal 70*a* is no longer grounded, current flow through the coil of the first relay 70 is interrupted, and the first relay 70 switch opens. Opening of the first relay 70 switch interrupts the positive voltage path from the power supply bus 80, through the first relay 70 switch, to the power output terminal 74, thereby cutting off power to the pump (P) and causing it to turn off.

Figure 15:
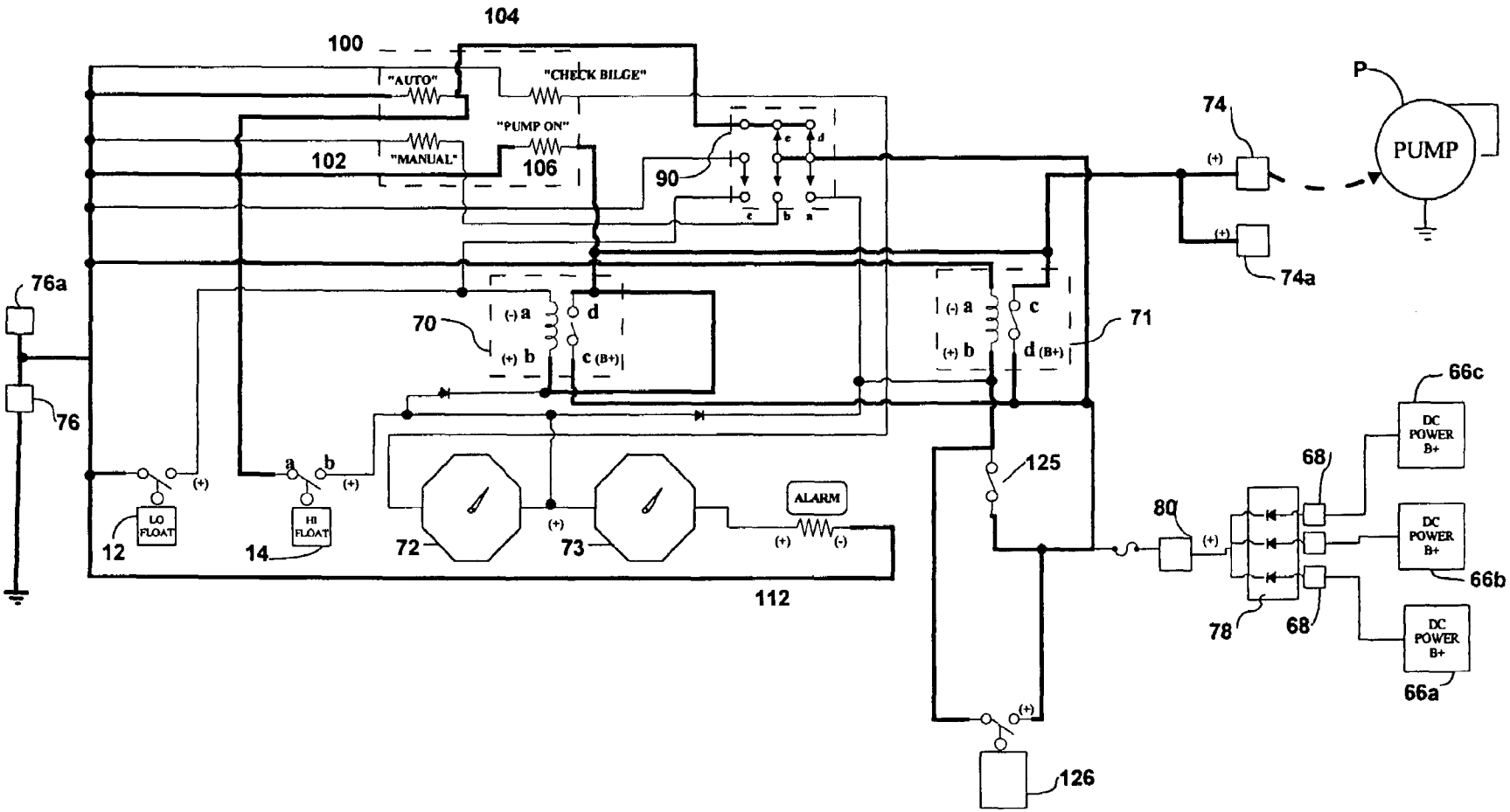
FIG. 15 is a schematic diagram of the bilge water level monitor, alert and pumping system shown in FIG. 8, shown with the remote switch in the "automatic" position and with the on-site manual switch closed.

Referring now to FIG. 15: If it is desired, for any reason, (regardless of whether either the high water level or low water level sensing units 12, 14 properly close), the pump (P) may be turned on manually by closing on-site manual bypass switch 125. On-site manual switch 125 is a normally open switch that preferably is located at the power pack unit 4, (as shown in FIGS. 5 and 18). In a modified embodiment of the invention the on-site manual switch 125 may be located remotely from the power pack unit 4, for example in close proximity to the pump (P). When the on-site manual switch 125 is closed, a positive voltage path is completed from the power supply bus 80, through the manual switch 125 to the positive coil terminal 71*b* of the second relay 71. Since the negative coil terminal 71*a* is hard-wired to the ground terminal 76, current flows through the coil of the second relay 71, thereby closing the second relay 71 across terminals 71*d* and 71*o*, Accordingly, a positive voltage path from the power supply bus 80, through the second relay 71 switch (terminals 7*c* and 71*d*), to the power out put terminal 74, to the pump (P), causes the pump to turn "on", If the on-site manual switch 125 is subsequently opened, the positive path (described above) to the positive coil terminal 7'Fo of the second relay is interrupted, causing the second relay 71 switch to open, and thereby cutting off power to the pump (P).

It will be understood from the above description that in a Monitoring System I constructed in accordance with the preferred embodiment of the invention, the primary function of the switch of the low water level sensing unit (12) is to make and break the ground (i.e., the ground path to the negative coil terminal 70*a*) for the first relay 70, The primary function of the switch of the high water level sensing unit 14 is to apply power to both first relay 70 and second relay 71. The relay coil (i.e., negative coil terminal 71*a*) of the second relay 71 is always grounded. When the float 34 of the low water level sensing unit 12 rises, it ~arms", or completes, the ground for the first relay 70. When the float 34 of the high water level sensing unit 14 rises, it sends power to both relays (70 and 71), causing both relays (70 and 71) to energize. As the water level lowers, the switch of the high water level sensing unit 14 opens the positive voltage circuit to the coils of both relays (70 and 71): however, the first relay 70 stays engaged as it is latched by means of the jumper from the power output (terminal 70*d*) to the positive coil terminal 70*b*. The first relay 70 will stay engaged until the low float (low water sensing unit 12) lowers enough to open the ground circuit. The primary function of the second relay is to provide some redundant automatic operations. It will be appreciated that even if the lower float (low water sensing unit 12) should fail for some reason, preventing the first relay 70 from functioning. the high float (high water sensing unit 14) would energize the second relay 71. In addition, the second relay 71 provides means for manual operation when it, (the second relay 71), receives the signal from the control panel 6, as is described more fully herein below.

Referring now to FIG. 16: In a modified embodiment of the invention, a back-up, 'redundant" water level sensing unit 126 is in parallel with the on-site manual bypass switch 125. The redundant water level sensing unit 126 is preferably constructed similarly to the high water level sensing unit 14, and is preferably installed in the bilge at a elevation than the high water level sensing unit 14. Whenever the water level is sufficiently high to cause the redundant water level sensing unit 126 to close, (regardless of whether or not the low or high water level sensing units 12 and 14 close), a positive voltage path is completed from the power supply bus 80, through the redundant water level sensing unit 126, to the positive coil terminal 71 *b* of the second relay 71, causing the second relay 71 switch to close. Accordingly, a positive voltage path is provided from the power supply bus 80, through the second relay 71 switch (terminals 71*d* and 71*c*), to the power out put terminal 74, to the pump (P), causing the pump to turn hon. even if the low and high water level sensing units 12 and 14 are defective. If the redundant high water level sensing unit 126 is subsequently re-opened (as would occur, for example, if the water level goes down), the positive path (described above) to the positive coil terminal 71*b* of the second relay is interrupted, causing the second relay 71 switch to open, and thereby cutting off power to the pump (P)—unless the low and high water level sensing units 12 and 14 are each in the closed position.

Figure 17:
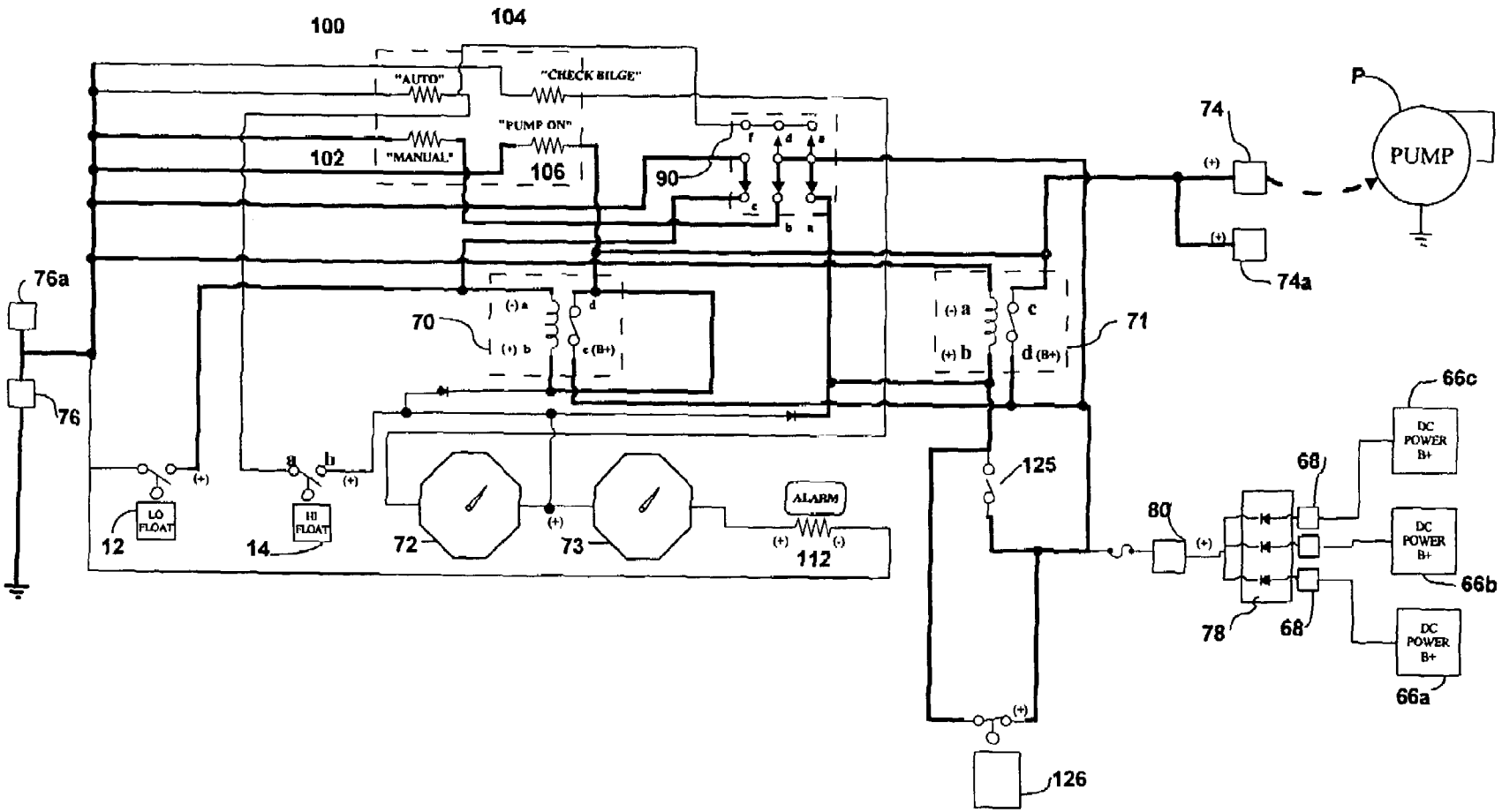
FIG. 17 is a schematic diagram of the bilge water level monitor, alert and pumping system shown in FIG. 8, shown with the remote switch in the "manual" position.

Main Control Panel 6,

Referring now to FIG. 17: Since it is desirable that the Monitoring System 1 be operable whenever it is connected to a power source 66, in the preferred embodiment of the invention neither the power pack unit 4 nor the main control panel 6 is provided with an 'on-off switch. However, on occasion it may be desirable for an operator to manually turn the bilge pump (P), or an auxiliary device, on from the main control panel 6. Accordingly, in the preferred embodiment of the invention, a manual-automatic switch 90 is provided at the main control panel 6 so that the operator may manually turn "on the bilge pump (P) (or an auxiliary device), regardless of the water level status in the bilge (B) or the position of the floats 34. Whenever the manual-automatic switch 90 is not in the manual position, the system is set for automatic" operation.

When the manual-automatic switch 90 is in the "manual" position (FIG. 17), a positive voltage path is provided from the power supply bus 80, through the manual-automatic switch 90 terminal 90*a*. to the positive coil terminal 71 *b* of the second relay 71, Since the negative coil terminal 71*a* of the second relay 71 is hard-wired directly to the ground terminal 76, current flows through the coil (terminals 71*b*, 71*a*) of the second relay 71 causing the second relay 71 switch (terminals 71*d*, 71*c*) to close. With the second relay 71 switch closed, a positive voltage path is provided from the power supply bus UU, through the second relay 71 switch (terminals 71*d*, 71*c*), to the power output terminal 74, to the pump (P), thereby causing the pump (P) to turn "on".

As shown in FIG. 18, the main control panel 6 houses the manual-automatic switch 90 for the Monitoring System 1, as well as four system status lights, namely: "Auto" light 100. "Manual" light 102, "check Bilge" light 104, and "Pump On" light 106.

As shown in FIG. 6, in the preferred embodiment of the invention the 'Auto' light 100 is green, the "Manual" light 102 is red, the "check Bilge" light 104 is flashing red, and the "Pump On" light 106 is amber.

The main control panel 6 comprises a housing 94 and a faceplate 92. The manual-automatic switch 90 is preferably a high quality three-pore double-throw switch for manual and automatic operation, By design no "off" position is provided at the control panel: the manual-automatic switch 90 is always set either for "automatic" operation of the Monitoring System 1 or for "manual" (i.e. pump on) operation of the Monitoring System 1.

The manual-automatic switch 90 is preferably located in the middle of the panel face plate 92. The two center power terminals of the manual-automatic switch 90 are connected in common, as are the automatic mode terminals 90*d*, 90*e* and 90*f*, in order to enhance switch operational integrity.

All electrical wiring from the main control panel 6 to the power pack unit 4 is made via a wiring harness 96, which, in the preferred embodiment of the invention, enters the housing 62 of the power pack unit 4 through a wiring harness port 98. Terminal 90*a* of the manual-automatic switch 90 is connected to the power supply bus 80 whenever the manual-automatic switch 90 is in the "manual" position. Terminal 90*a* is also connected to the positive coil terminal Jib of the second relay. Thus, whenever manual-automatic switch 90 is in the "manual" position, a positive voltage path is provided from the power supply bus 80, through terminal 90*a* of the manual-automatic switch 90, to the positive coil terminal 71*b* of the second relay 71. Since the negative coil terminal 71*a* of the second relay 71 is hard-wired to the ground terminal 76, that completes an electrical circuit through the relay terminals 71*b*, 71*a* of the second relay 71, thereby closing the second relay 71 switch (terminals 71*d*, 71*c*). This, in turn, completes a positive voltage path from the power supply bus 60, through the second relay switch terminals 71*d*, 71*c*, to the power output terminal 74, to the pump, thereby turning the pump P1 "on".

Terminal 90*b* of the manual-automatic switch 90 is connected to the "manual" light 102 (on the main control panel), and is also connected directly to the power supply bus 60 whenever manual-automatic switch 90 is in the "manual' position. Accordingly, whenever the manual-automatic switch 90 is in the "manual' position, the "manual" light turns on, It Will be understood from a review of the above description that turning the manual-automatic switch 90 to the "manual" position causes relay 71 to close and the pump (P) to turn on: and it will further be understood that this function is accomplished without necessitating closure of the first relay 70. For such operation, therefore, it is not necessary that terminal 90*c* of the manual-automatic switch 90 to be wired, However, in the preferred embodiment of the invention, FIG. 17) terminal 90*c* connects the negative coil terminal 70*a* of the first relay 70 to the ground terminal 76 whenever the manual-automatic switch 90 is in the "manual" position. When the switch 90 is so wired, closure of the manual-automatic switch 90 completes an electrical circuit from the power supply bus 80, through the second relay switch 71*d*, 71*c* (whose closure is described above), to the positive coil terminal 70*b* then the negative coil terminal 70*a* of the of the first relay, and finally to the ground terminal 76. This, in turn closes the first relay switch terminals 70*c*, 70*d*, thereby providing redundancy of power paths to the pump.

The "Pump On" light 106 is electrically connected between the ground terminal 76 and power output terminal 74, such that the "Pump On" light 106 turns "on" whenever power is supplied to the pump (for example, whenever the condition is as shown in FIG. 10, 11, 12, 13, 15, 16 or 17).

The "Check Bilge" light 100 on the control panel is electrically connected between the ground terminal 76 and first timer switch 72, such that the "Check Bilge" light 100 turns "on" whenever the first timer switch is turned "on".

The "Automatic" light 100 on the control panel is electrically connected between the ground terminal 76 and common terminals 90*d*, 90*e* and 90*f* of the manual-automatic switch 90. The common terminals 90*d*, 90*e* and 90*f* are connected to the power supply bus 80 whenever the manual-automatic switch 90 is in the "automatic" position, thereby causing the "Automatic" light 100 to turn "on" whenever the manual-automatic switch 90 is in the "Automatic" position.

It will be understood by those skilled in the art that, by incorporating load relay 70 (and timing devices 72 and 73, whose operation is discussed herein below), the described construction of the circuitry of the present invention minimizes voltage drop from the power pack unit 4 (located preferably in the vicinity of the pump (P)) to the sensing components (e.g. low water level sensing unit 12, high water sensing unit 14), and to the control components (e.g., manual pump switches 90. 94), and to the monitoring components (e.g., lights 100, 102, 104 and 106). It will be appreciated that because the voltage drop is minimized between the power pack unit 4 and the other components of the present invention (such as the water level sensing assembly 2, the main power control panel 6 and the remote status panel 8), the reliability of the bilge pump control circuitry is enhanced, and the gauge of electrical conductors between the power pack unit 4 and such remote devices can be minimized.

Means are provided to prevent relay low voltage cycling.

Labeling is preferably provided adjacent to each light (100, 102, 104 and 105) on the main control panel 6 describing what each light indicates (when tuned on).

The panel lights (100,102,104 and 106) are connected to the power pack 4 via wire harness 96, and connect to the power pack housing 62 through harness port 98. The wiring connections for lights 100, 102, 104, 106 may be made to the logic and control circuitry 64 in the power pack unit 4 at any location that completes an electrical circuit through the respective lights whenever the labeled condition is extant, But, by way of example, such connections may be as described herein above (and illustrated in FIGS. 6-18).

Remote Status Panel 8.

Figure 7:
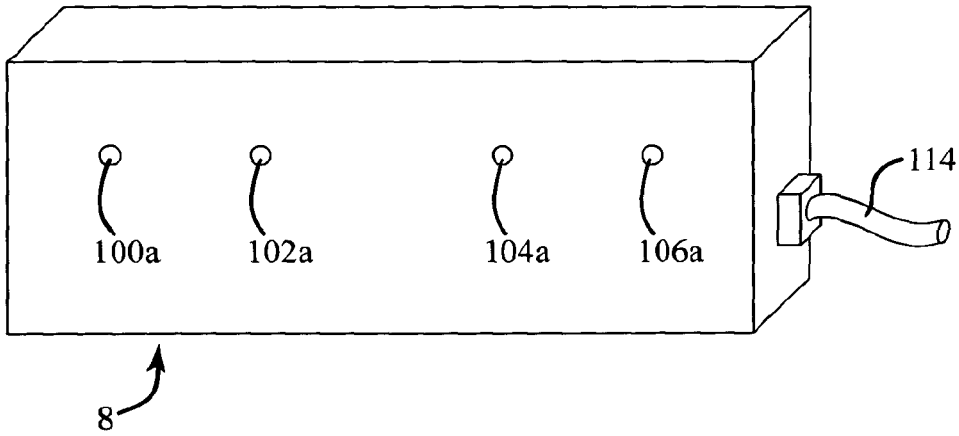
FIG. 7 is a perspective view of the remote status panel constructed in accordance with the preferred embodiment of the present invention.

Referring now to FIGS. 7 and 19: The optional Remote Status Panel 8 mirrors the construction and operation (more particularly the light functions, as described above) of the main control panel 6 but has no switch function. Electrical conductors from the remote status panel to the power pack unit 4 (and/or to the main control panel 6) are all carried via wiring harness 114, which enters the power pack unit 4 at wiring harness port 116. The wiring connections (not shown) of the four indicator lights (100*a*, 102*a*, 104*a* and 106*a*) of the remote status panel 8 are identical to corresponding lights (100, 102, 104 and 106, respectively) of the main control panel 6, as described herein above. In the preferred embodiment of the invention, the remote status panel 8 is operationally positioned at a location of control, such as the bridge or other occupied station, of the vessel in which the monitoring system 1 is installed, By so locating the remote status panel 8, an operator positioned at a remote location, such as the vessel's bridge or other occupied station of the vessel, can readily tell the status of the vessel's bilge, simply by observing the lights (100*a*, 102*a*, 104*a* and 106*a*) of the remote status panel 8.

It will be understood by those skilled in the art that, in the Monitoring System 1 constructed in accordance with the above described invention, whenever the pump (P) is turned on high power current flows from the power supply bus 80 directly to the power output terminal 74, passing through the high power terminals (70*c* and 70*d*, or 71*c* and 71*d*) of the first and/or second relay switches (70 and 71, respectively). It will further be understood by those skilled in the art that, conversely, no high power current flows through any sensing, control, signaling or switching components of the Monitoring System 1 constructed in accordance with the present invention. Accordingly, with the exception of the high power switching elements (i.e., between terminals 70*c* and 70*d*, or 71*c* and 71*d*) of the first and second relays (70 and 71, respectively) all the sensing. controlling, signaling, timing, and switching components (i.e., low water level sensing unit 12, high water level sensing unit 14, first timer switch 72, second timer switch 73, alarm 112, system status lights 100, 100*a*, 102, 102*a*, 104, 104*a*, 106 and 106*a*, and the relay coil terminals 70*a*, 70*b*, 71*a* and 71*b* of the first and second relays), as well as all wiring conductors there between (collectively referred to herein as the "low power components" of the Monitoring System 1) are preferably made with smaller gauge electrical conductors than are used, for example, between the power supply bus 80 and the high power switching elements (i.e., between terminals 70*c* and 70*d*, or 71*c* and 71*d*) of the first and second relays (70 and 71, respectively), Thus, as will be appreciated by those skilled in the art that, in a Monitoring System 1 constructed in accordance with the present invention, wiring harnesses 122, 124, 96, and 114 interconnecting the power pack unit 4, the water level sensing assembly 2, and the remote status the main control panel 6, are relatively lightweight.

Back-Up High Water Alarm/Control Unit 10.

Figure 4:
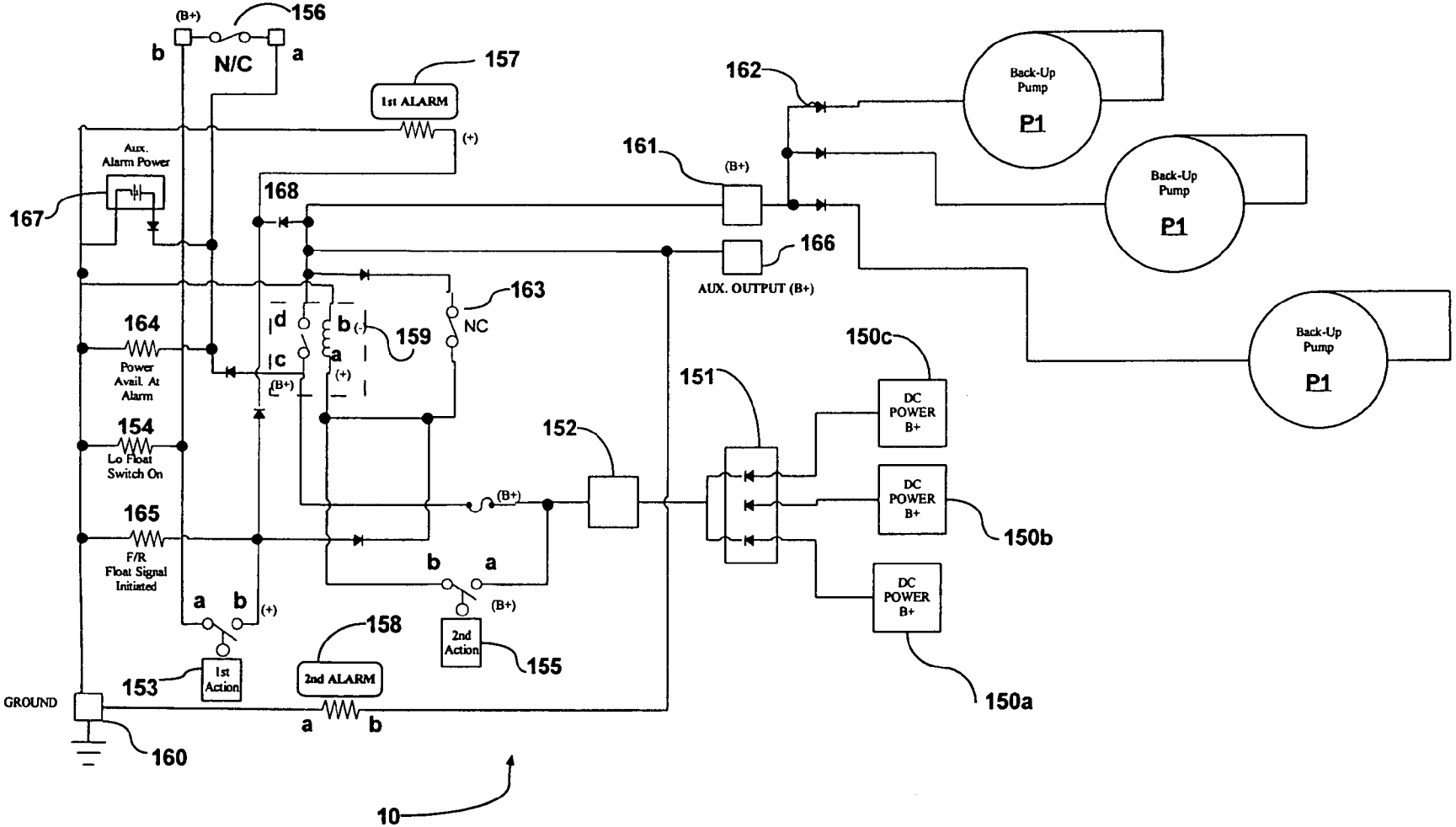
FIG. 4 is a circuit diagram of a back-up high water alarm/control unit in accordance with a modified embodiment of the invention.

Referring now to FIG. 4:

The primary function of the back-up high water alarm/control unit (herein referred to as "Back-Up Alarm Unit" 10) is to announce to persons aboard a vessel of high bilge water problems, and, if the vessel is unattended and at dockside, to gain the attention of persons that may be on the dock. Therefore, as will be described below, the BACK-UP ALARM UNIT 10 is provided with a bilge alarm that may be advantageously positioned in the engine room so that it may be readily heard through vents in the engine room and, accordingly, might more likely gain the attention of persons on the dock.

As secondary function of the BACK-UP ALARM UNIT 10 is to turn on back-up pumps, or all pumps that may be located in different areas of the vessel in order to protect the vessel.

A BACK-UP ALARM UNIT 10 is used in a modified embodiment of the invention. obtaining electrical power either directly from the same DC power supply 66 as the Monitoring System I (as shown in FIG. 1), or from a independent DC power supply 150 (as shown in FIG. 4). It will be appreciated that, the BACK-UP ALARM UNIT 10 can operate in conjunction with the Monitoring System 1 (as a largely redundant alarm system), or as a stand-alone system.

The BACK-UP ALARM UNIT 10 can be used (in the manner of the power pack unit 4) with multiple power sources. This system responds to a high water level switch that in turn operates the alarm signal and also energizes the power relay to provide power through the "power out" diode pack for one or more bilge pumps. Electronic latching is used for this component to ensure the alarm remains on. With the diode power to pumps provision, pumps at different locations can be operated in an emergency situation, but not affect normal independent bilge pump operation(s). This unit has its own water detection reed switch and can receive input from other water detection switches. There is a momentary at-site switch to turn off electronic latching. Operation and construction of the BACK-UP ALARM UNIT 10 is as follows:

Referring again to FIG. 4: Power to the BACK-UP ALARM UNIT 10 is provided by one or more DC power supplies 150. Each DC power supply 150*a*, 150*b*, 150*c* is connected to a diode pack 151. The each diode of the diode pack 151 is connected to the main power bus 152. A normally closed, manually operable system power switch 156 is connected to the main power bus 152. The system power switch 156 is connected to a first terminal 153*a* of a normally open low water level float switch (referred to herein as the "first action float switch") 153. A "Low Float Switch On" light 154 is connected between the first terminal 153*a* of the first action float switch 153 and the ground bus 160. The "Low Float Switch On" Fight 154 turns "on" whenever the system power switch 156 is closed.

The second terminal 153*b* of the first action float switch 153 is connected to the positive coil terminal 159*a* of relay 159. The negative coil terminal 159*b* of relay 159 is hard-wired to ground bus 160.

The first action float switch 153 is operationally installed in a vessel's bilge at an elevation below a normally open second action float switch 155. The first action float switch 153 is preferably also operationally installed in a vessel at an elevation that is slightly higher than the highest elevation that water in the bilge would ever reach during "normal" operation of the bilge system. In particular, in a system that also comprises power pack unit 4 and water level sensing unit 2, the first action float switch 153 is preferably operationally installed in a vessel bilge at an elevation that is slightly above the elevation at which float 34*b* of the high water sensing unit 14 causes reed switch 36*b* to close.

A first alarm 157 is electrically connected between the ground bus 155 and terminal 153*b* of the first action float switch 153, When water in the bilge (not shown) is high enough to cause the first action float switch 153 to close, a circuit is completed from the power bus 152, through the system power switch 156, through the first action float switch 153, through the first alarm 157, to ground 160—thus turning the first alarm 157 "on".

A "Float Signal Initiated" light 165 is connected between the ground terminal 160 and terminal 153*b* of the first action float switch 153, in parallel with the first alarm 157. When water in the bilge (not shown) is high enough to cause the first action float switch 153 to close, a circuit is completed from the power bus 152, through the system power switch 156, through the first action float switch 153, through the "Float Signal Initiated" light 165. to ground 160—thus, turning the flashing) 'Float Signal Initiated" tight 165 "on".

Preferably, the first alarm 157 is located in the vessels living quarters (not shown), Whenever the "Float Signal Initiated" light 165 is turned "on", the operator preferably should also be able to hear the first alarm's signal.

A first terminal 155*a* of the second action float switch 155 is connected to the power supply bus 152. The second terminal 155*b* of the second action float switch 155 is connected to the positive coil terminal 159*a* of relay 159. As described above, the negative coil terminal 159*b* of relay 159 is hard-wired to ground bus 160.

When water in the bilge (not shown) is high enough to cause the second action float switch 155 to close, a positive voltage path is completed from the power supply bus 152, through the second action float switch 155, to the positive coil terminal 159*a* of the relay 159, thereby completing the electrical circuit through the relay's 159 coil, This causes relay 159 to close across relay switch terminals 159*c* and 159*d*, A switch output terminal 159*d* of the relay 159 is connected to the power output bus 161. One or more back-up pumps (P1) may be connected to the power output terminal 161. When relay 159 closes (i.e., upon the closure of second action float switch 155), a positive voltage path is completed from the power supply bus 152, through the relay switch terminals 159*c*, 159*d*, to the power output terminal 161, thereby turning "on" the back-up pump(s) (P1). If multiple back-up pumps (P1) are used, then diodes 162 may be inserted in series with the back-up pumps (P1), to ensure independent operation of the multiple pumps, The switch output terminal 159*d* of the relay 159 is connected, through a normally closed manual switch 163, to the positive coil terminal 159*a* of the relay 159. When relay 159 initially closes (i.e., upon the closure of second action float switch 155), it thereby latches a positive voltage path to the positive coil terminal 159*a* of the relay, causing the relay 159 to stay closed (since the negative coil terminal 159*b* is hard-wired to ground 160), and thereby causing the first alarm 157 and the pump (P1) to stay on, It will be appreciated that once the relay is latched in the closed position (as described above), power will be supplied to the pump (P1) even in the event that the second action float switch 155 subsequently reopens. It will further be understood, then, that in order to turn the pump off (subsequent to its initially being turned on by closure of the second action float switch 155), the normally closed manual switch 163 must be manually opened. Doing so (i.e., opening the normally closed manual switch 163) interrupts the positive voltage path to the relay 159 coil (terminal 159*a*). thereby causing the relay's 159 switch (terminals 159*c*, 159*d*) to open, and cutting off power to the power output terminal 161 and the back-up pump(s) (P1)—unless here is still sufficiently high water in the bilge to keep the second action float switch 155 closed.

A second alarm 158, which is preferably located in the vicinity of a vessel's engine room, is connected in series between the switch output terminal 159*d* of the relay 159 and the ground terminal 160. Accordingly, whenever the relay 159 is closed (i.e., after the second action float switch 155 initially closes), the second alarm 158 turns "on", It will further be understood, then, that after the second action float switch 155 initially closes (indicative of high water in the bilge), neither the first alarm 157. the second alarm 158, nor the back-up pump(s) (P1) will turn-off without human intervention (i.e., manually opening the normally closed manual switch 163).

A "Power Available at Alarm" light 164 is connected between the ground terminal 160 and the power supply bus 152. The "Power Available at Alarm" light 164 turns "on" whenever DC power is connected to the main power supply bus 152. One or more auxiliary output terminal 166 may be connected to the switch output terminal 159*d* of the relay, in series with power output terminal 161. The auxiliary output terminal 166 may be used, for example, for connection of additional alarms, signals or pumps (not shown).

Still referring to FIG. 4: An auxiliary alarm power supply 167 such as a back-up battery/transformer) is preferably connected between the ground terminal 160 and "hot" first terminal 156*a* of the system power switch 156, The auxiliary alarm power supply 167 provides sufficient power to turn on the first alarm 157, (i.e., whenever the first action float switch 153 is closed) in the event that, for any reason (including shorts, dead batteries, inadvertent disconnection of lines, etc), there is not sufficient power supplied to the alarm 157 from the main power bus 152. It will be understood that, because the auxiliary alarm power supply 167 is connected to the "hot" side 156*a* of the system power switch 156, auxiliary power is available to the first action float switch 153 whenever the system power switch 156 is closed. Thus, in the event that the first action float switch 153 closes, it is possible to turn off the first alarm 151 simply by opening the system power switch 156. Diode 168 is provided to ensure that there is enough power (from by the auxiliary power supply 167) to turn on the first alarm 157, but that that power from the auxiliary power supply 156 is not drained, for example, by the pump (P1).

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed:

1. An apparatus for detecting and controlling bilge water in a sea vessel, said system comprising:

(a) a water level sensing assembly constructed for operation within a sea vessel's bilge compartment comprising;

(i) a low water level sensing unit including a water level sensing housing body, a water level sensing housing bottom, a water level sensing housing bottom opening with an outward facing counter sunk opening for reducing clogging while allowing bilge water to enter a float chamber disposed within the water level sensing housing body from outside the water level sensing housing body, a float chamber sidewall opening allowing water flow directly to a float assembly disposed within the float chamber when a slosh guard disposed within said float chamber is clogged, the float assembly adapted and configured for applying force to a reed switch when the water level raises, the reed switch for completing an electrical circuit to a first relay, a slosh guard for reducing water particles from contacting the float assembly and two reed switch wires for transferring an electrical signal from the reed switch to the first relay; and (ii) a high water level sensing unit including a water level sensing housing body, a water level sensing housing bottom, a water level sensing housing bottom opening with an outward facing counter sunk opening for reducing clogging while allowing bilge water to enter the float chamber from outside the housing, a float chamber sidewall opening to allow water flow directly to the float when the slosh guard is clogged, a float for applying force to the reed switch when the water level raises, a reed switch for completing an electrical circuit to a second relay, a slosh guard for reducing water particles from contacting the float assembly and two reed switch wires for transferring an electrical signal from the reed switch to the second relay;

(b) a power pack unit constructed for operation within an engine room area comprising;

a housing for enclosing the logic and control circuitry for the power pack unit, power input terminals for connecting the power pack unit to multiple DC power supplies, power output terminals for connecting to multiple bilge pumps, a diode pack connected to the power input terminals to isolate batteries disposed in said housing and operatively connected to said diode pack for multiple power source connections, harness ports for connecting a low and high water level sensing unit wiring harness, a harness port for connection of a wiring harness from a main control panel, a harness port for an optional wiring harness connection from a remote status panel, an electrical connection from the low water level sensing unit's reed switch and a negative coil terminal of the first relay, an electrical connection from the high water level sensing unit's reed switch and a positive coil terminal of the second relay, first timer switch, second timer switch, and an on-site manual switch for manually turning on pumps without disengaging a monitoring and alarm system, said power pack unit responds to signal inputs to control bilge pump function;

(c) a main control panel constructed for operation within the engine room area comprising;

a main control panel housing, an indicator for indicating that the monitoring and alarm system is in an automatic mode, an indicator for indicating that the monitoring and alarm system is in a manual mode, indicator for indicating that the bilge pumps have been energized, an indicator for indicating that the bilge pumps have been energized for an extended time period, a main control panel wiring harness for connecting the main control panel to the power pack unit, a remote status panel harness for connecting a remote status panel to the main control panel and a double-throw triple-pole switch for switching the system from the automatic to the manual mode of operation;

(d) a remote status panel constructed for operation within any area of the vessel comprising;

a main status panel housing, the automatic mode indicator, the manual mode indicator, the pimp on indictor, the check bilge indicator the automatic mode indicator, the manual mode indicator, the pimp on indictor, the check bilge indicator, a remote status panel wiring harness for connecting the remote status panel to the main control panel;

(e) a back-up high water alarm/control unit constructed for operation within the engine room area comprising;

a housing for enclosing alarm/control logic and control circuitry for the back-up high water alarm/control unit, power input terminals for connecting the power pack to multiple DC power supplies which can be either an existing DC power supply or an independent power supply for redundancy, power output terminals for connecting to multiply bilge pumps which can be either existing bilge pumps or independent bilge pumps, a diode pack connected to the power input terminals isolating batteries from multiple power source connections, a system on-off switch which is normally closed and connected in series with a first action float switch, the first action float switch being located in a bilge area at an elevation higher than the high water level sensing unit as a safety back up feature, a Low Float On light, a second action float switch located in the bilge at an elevation slightly higher than the highest elevation that water in the bilge would ever reach during normal operation, a first alarm for activation when the first action float switch is closed, a Float Signal Initiated light for activation when the first action float switch is closed, and a second action float switch which is connected to a positive terminal of the relay thereby turning on the backup pumps when the second action float switch is closed;

(f) a redundant high water level sensing unit constructed for operation within the engine room area comprising;

a water level sensing housing, a water level sensing housing bottom, a water level sensing housing bottom opening with an outward facing counter sunk opening for reducing clogging while allowing bilge water to enter a float chamber from outside the water level sensing housing, a float chamber sidewall opening allowing water flow directly to a float when a slosh guard is clogged, a float for applying force to a reed switch when the water level raises, the redundant high water level sensing unit being connected in parallel with an on-site manual switch, the the redundant high water level sensing unit being preferably installed in the bilge at an elevation higher than the high water level sensing unit.

2. The apparatus for detecting and controlling bilge water in a sea vessel set forth in claim 1 wherein said low water level sensing unit and the high water level sensing unit are mechanically supported to a structure of a vessel and the low water level sensing unit is preferably located at a lower elevation than the high water level sensing unit.

3. The apparatus for detecting and controlling bilge water in a sea vessel set forth in claim 1 wherein said first alarm is preferably located in a vessel's living quarters.

4. The apparatus for detecting and controlling bilge water in a sea vessel set forth in claim 1 wherein said power pack unit includes a manual pump operating switch for manually operating a pump without deactivating a monitoring and alarm system.

5. The apparatus for detecting and controlling bilge water in a sea vessel set forth in claim 1 wherein the water level sensing unit, the power pack unit, the main control panel and the remote status panel are operated with low voltage circuitry and components and wired with and connected to each other with low voltage cables thereby not reducing voltage drop to the bilge pumps.

6. The apparatus for detecting and controlling bilge water in a sea vessel set forth in claim 1 wherein the wiring between the water level sensing unit, the power pack unit, the main control panel and the remote status panel are not exposed to bilge water thereby reducing the damage to wiring.

7. The apparatus for detecting and controlling bilge water in a sea vessel set forth in claim 1 wherein the power pack is equipped with a diode pack connected between the DC power supply and the power supply bus for connecting a plurality of batteries in parallel thereby reducing the likelihood of exhausting battery power in the event of a significant seawater leakage problem.

8. The apparatus for detecting and controlling bilge water in a sea vessel set forth in claim 1 wherein the backup high water alarm/control unit is used for a redundant unit or a stand alone unit.

9. The apparatus for detecting and controlling bilge water in a sea vessel set forth in claim 8 wherein at least one of the first action float switch and the second action float switch is preferably positioned at a higher elevation than the redundant high water level sensing unit for safety.

10. The apparatus for detecting and controlling bilge water in a sea vessel set forth in claim 8, further comprising a manual off switch for safety, and wherein said manual off switch is designed to be reset manually after the first alarm, the second alarm and the backup pumps have been energized.

11. The apparatus for detecting and controlling bilge water in a sea vessel set forth in claim 1 wherein the power pack unit's first timer switch has a preset time such as 2 minutes for energizing a check bilge alarm light after the preset time period is completed and the second timer switch has a preset time such as 4 minutes for energizing an audible alarm after the preset time period is completed.

* * * * *